US011016413B2

(12) United States Patent
Omata et al.

(10) Patent No.: US 11,016,413 B2
(45) Date of Patent: May 25, 2021

(54) IMAGE FORMING APPARATUS THAT CONTROLS A THERMAL FIXING CONDITION OF A FIXING PORTION BASED ON THERMAL CHARACTERISTIC INFORMATION OF TONER

(71) Applicant: CANON KABUSHIKI KAISHA, Tokyo (JP)

(72) Inventors: Masahito Omata, Yokohama (JP); Yasuhito Minamishima, Odawara (JP); Takao Kume, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/732,668

(22) Filed: Jan. 2, 2020

(65) Prior Publication Data

US 2020/0133162 A1 Apr. 30, 2020

Related U.S. Application Data

(63) Continuation of application No. 15/989,520, filed on May 25, 2018, now Pat. No. 10,558,143.

(30) Foreign Application Priority Data

May 31, 2017 (JP) ..... JP2017-107537

(51) Int. Cl.

| | |
|---|---|
| ***G03G 15/08*** | (2006.01) |
| ***G03G 15/20*** | (2006.01) |
| ***G03G 15/16*** | (2006.01) |
| ***G03G 21/18*** | (2006.01) |

(52) U.S. Cl.

CPC ..... *G03G 15/0865* (2013.01); *G03G 15/08* (2013.01); *G03G 15/0863* (2013.01);
(Continued)

(58) Field of Classification Search

CPC ..... G03G 15/0863; G03G 21/1889; G03G 2215/0697; G03G 15/556

See application file for complete search history.

(56) References Cited

U.S. PATENT DOCUMENTS

| | | | |
|---|---|---|---|
| 7,962,052 | B2 | 6/2011 | Ishino |
| 2009/0110417 | A1 | 4/2009 | Homma et al. |

(Continued)

FOREIGN PATENT DOCUMENTS

| | | | |
|---|---|---|---|
| JP | H02-132481 | A | 5/1990 |
| JP | H09-34163 | A | 2/1997 |

(Continued)

OTHER PUBLICATIONS

Japanese Office Action dated Apr. 6, 2021, in Japanese Patent Application No. 2017-107537.

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus includes a plurality of cartridges containing toners, each cartridge including a storage element that stores a type of thermal characteristic information of the toner contained therein, and a reading portion configured to read the type of thermal characteristic information. A fixing portion thermally fixes a toner image, formed by a plurality of toners of different colors contained in the cartridges, respectively, onto a recording material, and a control portion controls the fixing portion by switching a thermal fixing condition in accordance with a combination of the types of the thermal characteristic information read by the reading portion, the thermal fixing condition being a condition that prioritizes the performance of fixing, to a recording material, a toner, of the toners that form the toner
(Continued)

image, that is transferred first to the recording material, from among the plurality of toners of different colors.

15 Claims, 11 Drawing Sheets

(52) U.S. Cl.
CPC ..... *G03G 15/16* (2013.01); *G03G 15/20* (2013.01); *G03G 15/2039* (2013.01); *G03G 15/2053* (2013.01); *G03G 15/2064* (2013.01); *G03G 21/1889* (2013.01)

(56) References Cited

U.S. PATENT DOCUMENTS

| | | | | |
|---|---|---|---|---|
| 2010/0209122 | A1* | 8/2010 | Ishino ..... | G03G 15/2039 399/12 |
| 2011/0274451 | A1* | 11/2011 | Kawaguchi ..... | G03G 15/0121 399/38 |
| 2016/0139550 | A1* | 5/2016 | Ishida ..... | G01N 29/0654 399/45 |

FOREIGN PATENT DOCUMENTS

| | | | |
|---|---|---|---|
| JP | H09-090809 | A | 4/1997 |
| JP | 2006-010783 | A | 1/2006 |
| JP | 2007-199361 | A | 8/2007 |
| JP | 2007-304186 | A | 11/2007 |
| JP | 2010-186133 | A | 8/2010 |
| JP | 2011-237774 | A | 11/2011 |

* cited by examiner

IMAGE FORMING APPARATUS THAT CONTROLS A THERMAL FIXING CONDITION OF A FIXING PORTION BASED ON THERMAL CHARACTERISTIC INFORMATION OF TONER

This application is a Continuation of U.S. patent application Ser. No. 15/989,520, filed May 25, 2018, which claims the benefit of Japanese Patent Application No. 2017-107537, filed on May 31, 2017, which are both hereby incorporated by reference herein in their entireties.

BACKGROUND OF THE INVENTION

Field of the Invention

The present invention relates to an image forming apparatus configured to form an image on a recording material by using an electrophotographic system.

Description of the Related Art

Image forming apparatuses using an electrophotographic system, such as copiers and laser beam printers, have been constantly improving to have faster processing, higher functions, and better colorization, and various types of image forming apparatuses have been proposed. In terms of faster processing, research and development on an in-line type image forming apparatus is advancing. This is an image forming apparatus in which a plurality of image forming portions (image forming units), each of which forms a different color image, are disposed in series, and an image is formed by driving these image forming portions simultaneously. This type of image forming apparatus is extremely useful in a business in which fast printing is highly demanded, since color images can be formed at high-speed.

A process cartridge type is a conventional image forming apparatus in which each image forming portion, which is disposed in series to form a toner image having a plurality of colors, has a process cartridge that is detachably attached to the image forming apparatus main body. If such a process cartridge type is used, the operator can replace the process cartridge when toner runs out, for example, whereby other consumables, such as a photosensitive drum, can also be replaced, and maintainability dramatically improves.

In a process cartridge, low temperature fixing performance, good offset resistance, and high gloss values may be implemented by improving the developer in the developing apparatus. To stably acquire high gloss values, improving the endothermic peak of the resin and wax in toner was disclosed, for example, in Japanese Patent Application Publication No. H9-34163. In other words, a process cartridge supporting high gloss can be newly created by changing the toner.

Further, a configuration to support the case in which such an improved process cartridge, in which toner is changed, and a current process cartridge coexist in an image forming apparatus main body, was proposed, for example, in Japanese Patent Application Publication No. 2007-199361. In concrete terms, a memory disposed in a process cartridge stores the fixing performance of the toner, and a reading apparatus reads this information, and the target temperature of the fixing apparatus is changed only when this information satisfies a predetermined conditions.

The fixing performance of mass produced toner varies. Normally, an image processing apparatus is designed with an allowance for a margin in the fixing performance, but, in the case of a color image forming apparatus in particular, a plurality of colors (normally yellow (Y), magenta (M), cyan (C), and black (Bk)) of toners are used. Hence, the fixing performance varies even more. Further, in the case of a color image forming apparatus, there is a sequence of colors to form each color of a toner image, and, therefore, the fixing performance of multi-order color changes depending on the combination of the color and the fixing performance of the toner used for the image formation. This means that, even if toners having the same fixing performance are used, the optimum fixing temperature is different depending on the color for which the toner is used. Hence, if all combinations of the colors of toners are fixed uniformly at the same target temperature, a fixing failure, such as over-fixing (hot offset) or insufficient fixing (cold offset), may be generated.

In Japanese Patent Application Publication No. 2007-199361, a case of using an improved toner (high gloss toner), which has a toner that is different from a normally used fixing performance, is disclosed. In other words, the fixing performance information on the toner, written in the memory tag disposed in the cartridge, is read by a reading device disposed in the image forming apparatus, and the fixing target temperature is increased only when high gloss toners are used for all four colors. In the case when the toners having different fixing performances are installed at the same time, however, the fixing target temperature is not switched to an optimum fixing target temperature for each combination of toners.

SUMMARY OF INVENTION

An object of the present invention is to provide an image forming apparatus that sets an optimum fixing target temperature for each of the various combinations of toners, which have not only different colors but also different fixing performances, so that no fixing failure, i.e., over-fixing or insufficient fixing, occurs.

To achieve this object, in one aspect, the present invention provides an image forming apparatus including an apparatus main body, a plurality of cartridges configured to contain toners and detachably attached to the apparatus main body, a fixing portion configured to thermally fix a toner image, which is formed by a plurality of toners of different colors contained in the plurality of cartridges, respectively, onto a recording material, and a control portion configured to control the fixing portion, wherein each of the plurality of cartridges includes a storage element that stores a type of thermal characteristic information on the toner, which is classified into at least two types and which is contained in each of the cartridges, wherein the image forming apparatus further comprises a reading portion configured to read a type of thermal characteristic information stored in the storage element, and wherein the control portion switches a thermal fixing condition to control the fixing portion in accordance with a combination of the types of the thermal characteristic information that has been read by the reading portion.

According to the present invention, an optimum fixing target temperature can be set for various combinations of toners, which have not only different colors but also different fixing performance, whereby the generation of a fixing failure, such as cold offset and hot offset, and image sticking, can be suppressed.

Further features of the present invention will become apparent from the following description of exemplary embodiments with reference to the attached drawings.

DESCRIPTION OF THE EMBODIMENTS

Hereafter, a description will be given, with reference to the drawings, of embodiments (examples) of the present invention. The sizes, materials, shapes, their relative arrangements, or the like, of constituents described in the embodiments may, however, be appropriately changed according to the configurations, various conditions, or the like, of apparatuses to which the invention is applied. Therefore, the sizes, materials, shapes, their relative arrangements, or the like, of the constituents described in the embodiments do not intend to limit the scope of the invention to the following embodiments.

Example 1

Figure 1:
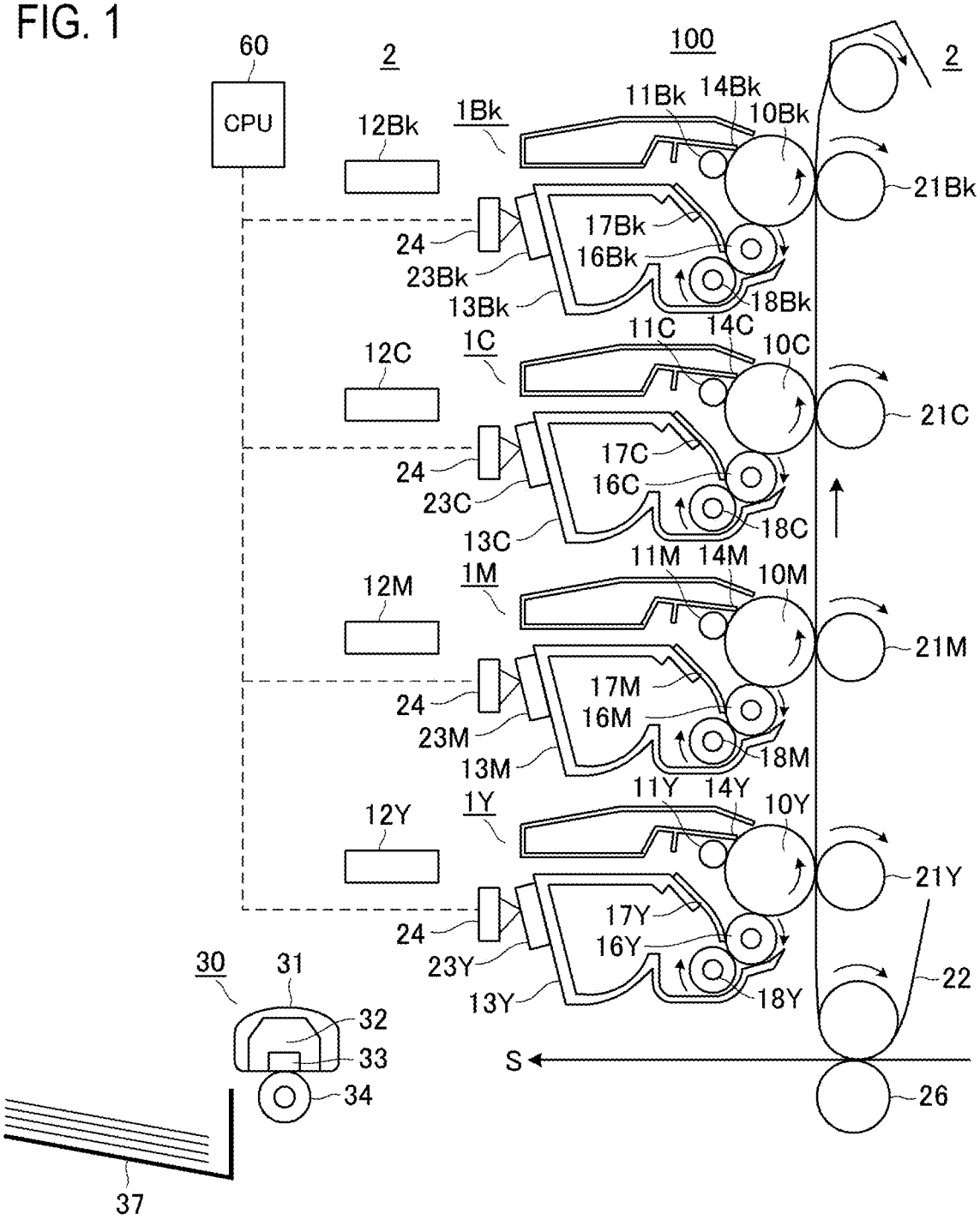
FIG. 1 is a schematic cross-sectional view depicting a key portion of an image forming apparatus according to an example of the present invention.

FIG. 1 is a schematic cross-sectional view depicting a key portion of an image forming apparatus 100 of Example 1. Here, a case of applying the present invention to an in-line type color printer will be described, but an image forming apparatus to which the present invention can be applied is not limited to the apparatus described in Example 1. The image forming apparatus 100 of Example 1 can form an image on a transfer material, such as a recording paper, an overhead projector (OHP) sheet, or a cloth, using the electrophotographic system, in accordance with input image information signals, and output the image. The image information signals are provided from an external host device, such as a personal computer (PC), which is communicably connected with an image forming apparatus main body 2. The image information signals are converted into image information using each color of yellow (Y), magenta (M), cyan (C), and black (Bk), which are the toner colors used for image formation, described later, via a formatter 61 (not illustrated), and the image information is sent to a central processing unit (CPU) 60. In FIG. 1, the image forming apparatus main body 2 is a portion of the image forming apparatus 100 from which process cartridges 1 are excluded.

The image forming apparatus 100 forms an image of each color of yellow (Y), magenta (M), cyan (C), and black (Bk), as an image forming process based on the image information, mentioned above. The process cartridges 1 (1Y, 1M, 1C, 1Bk), which form an image of each color, are disposed in series along an intermediate transfer belt 22, which circles around in the arrow direction, as a transfer member, and constitute first to fourth image forming portions to form an image of each color. In other words, transferred images corresponding to yellow, magenta, cyan, and black cartridges, which are disposed vertically on a line sequentially from the bottom in FIG. 1, are conveyed by the intermediate transfer belt 22, and the toner images are transferred onto a transfer material (recording material) S by a secondary transfer roller 26. Thereby, a full color image can be formed.

In Example 1, the image forming portion for each color has essentially the same configuration, except that the color of the image to be formed is different. Hence, in the following description, the image forming portion is described in general, omitting the suffixes Y, M, C, or K to indicate each color of the image forming portion, unless distinction thereof is especially required.

Each image forming portion includes a drum type electrophotographic photosensitive member (photosensitive drum) 10 as an image bearing member, respectively. The surface of the photosensitive drum 10 is uniformly charged by a charging roller 11, which is a charging unit that is rotated by the rotation of the photosensitive drum 10. Then, an exposing apparatus 12 (exposing unit) scans and exposes the photosensitive drum with light signals in accordance with the image information signals, whereby an electrostatic latent image is formed on the surface of the photosensitive drum 10. On this electrostatic latent image, toner (developer) is adhered by a developing apparatus 13 (developing unit), and the electrostatic latent image is visualized as a developer image (toner image).

The charging roller 11 uniformly charges the surface of the photosensitive drum 10 at a predetermined potential, by applying voltage that is supplied from a high voltage power supply (not illustrated) via an electrode of the charging roller 11. Further, the charging roller 11 is pressed against the surface of the photosensitive drum 10 with a predetermined pressing force, and charges the photosensitive drum 10 while being rotated by the rotation of the photosensitive drum 10. A laser scanner 12, which is an example of the exposing unit, supplies light signals, modulated by the image signals from the image signal source, to the surface of the uniformly charged photosensitive drum 10, so as to form an electrostatic latent image corresponding to the image signals.

The developing apparatus 13 contacts a developing roller 16, which is a developer carrying member to convey the developer to the photosensitive drum 10, to the photosensitive drum 10, so as to perform development (contact developing system). In other words, a predetermined amount of toner is transferred to the side of the electrostatic latent image formed on the photosensitive drum 10, at the contact section (developing section) between the photosensitive drum 10 and the developing roller 16, whereby a visible image corresponding to the electrostatic latent image is formed. The predetermined amount of the toner is determined based on the relationship between the light/dark part potential generated by the electrostatic latent image formed on the photosensitive drum 10 and the bias voltage applied to the developing roller 16.

The developing apparatus 13 includes the developing roller 16, which contacts the photosensitive drum 10, and a toner supply roller 18, which is a developer supply member to supply toner to the developing roller 16, inside a developer container (developing apparatus 13 main body). The developing apparatus 13 also includes a developing blade 17, which is a developer control member to control the toner to be supplied onto the developing roller 16, inside the developer container. The developing roller 16 is configured to contact the surface of the photosensitive drum 10, so as to be rotated by the rotation of the photosensitive drum 10, and is disposed such that a part of the developing roller 16 is exposed from the developer container. The developing blade 17 is configured to contact the developing roller 16. By the toner passing the contact section between the developing blade 17 and the developing roller 16, a thin layer of the toner is formed on the developing roller 16, and sufficient frictional charges (tribo charges) are provided to the toner by the friction at this contact section.

For example, a full color image is formed in the following sequence. First, in each image forming portion, a predetermined transfer bias is applied to a primary transfer roller 21 (transfer means). Thereby, at a transfer unit where the photosensitive drum 10 and the primary transfer roller 21 face each other in each image forming portion, a toner image of each color, formed on the photosensitive drum 10, is transferred to the intermediate transfer belt 22. The image transferred onto the intermediate transfer belt 22 is transferred again onto the transfer material S by the secondary transfer roller 26, whereby a full color unfixed image is formed on the transfer material S.

Then the transfer material S, on which the toner image is transferred, is conveyed to the fixing apparatus 30 (fixing portion), where the unfixed image is fixed to the transfer material S.

Figure 2:
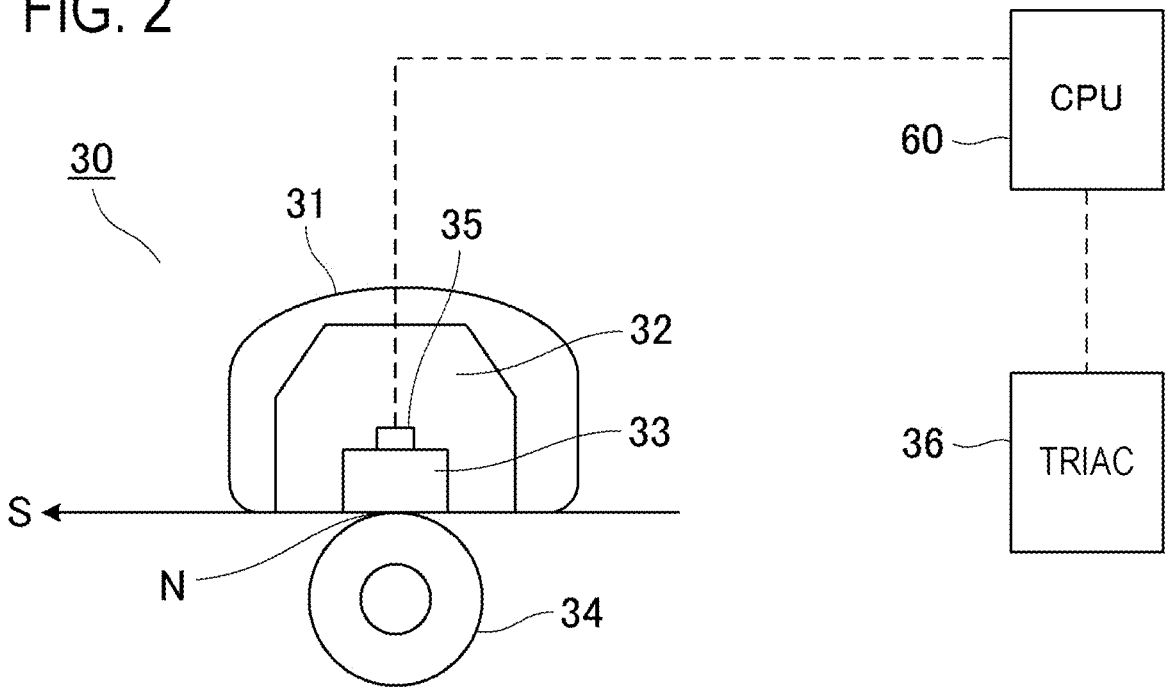
FIG. 2 is a schematic cross-sectional view of a fixing apparatus according to an example of the present invention.

FIG. 2 is a schematic cross-sectional view of the fixing apparatus 30. The fixing apparatus 30 is a heating apparatus that heats a fixing film 31, and is normally configured as follows. The fixing film 31 is constituted by a thin heat resistant resin (e.g. polyimide). A heater 33, which is secured by a heater holder 32, is disposed on one surface side of the fixing film 31, so that a pressure roller 34 is pressed against the heater 33 via the fixing film 31, whereby a fixing nip N is formed. A thermistor 35 is a temperature detecting element to which the heater 33 is contacted. A triac 36 supplies power to the heater 33. The triac 36 is connected to the heater 33, so that power can be supplied to the heater 33. The temperature of the heater 33 is detected by the thermistor 35, and the detected temperature is sent to the CPU 60, which is a control portion of the apparatus main body. The CPU 60 controls the supply of the power to the heater 33 using the triac 36 based on this temperature information, so as to control the heater 33 at a predetermined fixing target temperature. The recording material S, on which an unfixed image is transferred, passes through the fixing nip N, where the heater 33 and the pressure roller 34 are contacted with pressure via the fixing film 31, whereby the unfixed image of toner receives heat and pressure, and is thermally fixed onto the transfer material S. The transfer material S, on which the image is fixed, is discharged into a paper delivery tray 37, and the image formation ends.

The configuration of the process cartridge 1, which can be detachably attached to the image forming apparatus main body 2 according to Example 1, will be described. The image forming apparatus 100 is constituted by the image forming apparatus main body 2 and the process cartridges 1.

Untransferred toner, which was not transferred in the transfer step and which remains on the photosensitive drum 10, is collected to a waste toner container, and the surface of the photosensitive drum 10 is cleaned by a cleaning apparatus 14. The cleaning apparatus 14 is a cleaning unit of the image bearing member, and includes a cleaning blade and the waste toner container.

In this example, the photosensitive drum 10 has a 30 mm diameter, and is rotary-driven in the arrow direction in FIG. 1 at a 100 mm/sec peripheral velocity. The surface of the photosensitive drum 10 is uniformly charged by the charging roller 11.

A −1150 V direct current (DC) voltage is applied to the charging roller 11 by a charging bias power supply (not illustrated), which is a high voltage power supply, and the surface of the photosensitive drum 10 is uniformly charged at about a −600 V dark part potential. In Example 1, a DC bias is used as the charging bias, but a bias generated by superimposing an alternating current (AC) component onto a DC component may be used as the charging bias.

To form an electrostatic latent image on the surface of the photosensitive drum 10, a laser, of which ON/OFF is controlled by the exposing apparatus 12 in accordance with the image data input to the image forming apparatus main body 2, is used. The light part potential becomes about −80 V after scanning and exposing the surface of the photosensitive drum 10.

The developing apparatus 13 has the configuration described above, and develops, in reverse, the electrostatic latent image on the photosensitive drum 10 using toner having the same charging polarity as the charging polarity of the photosensitive drum 10 (negative polarity in Example 1), based on the contact developing system.

In concrete terms, the developing apparatus 13 includes a developer container (main body of developing apparatus 13), which contains non-magnetic toner (one component toner) having negative chargeability, which is a one component developer, and the developing roller 16, which is a developer carrying member. Further, the developing apparatus 13 is constituted by the developing blade 17, which is a developer controlling member, the toner supply roller 18, which is a developer supply member, and a stirring blade, which is a developer stirring and conveying unit (not illustrated).

In Example 1, the developing roller 16 has a metal core made of aluminum or an aluminum alloy, for example, and an elastic layer, which surrounds the metal core, and has a 16 mm outer diameter. In Example 1, the developing roller 16 is rotary-driven by a driving unit (not illustrated) at a 160 mm/sec peripheral velocity.

During the developing step, the electrostatic latent image formed on the photosensitive drum 10 becomes visible by the toner carried by the developing roller 16, which is in contact with the surface of the photosensitive drum 10, whereby the toner image is generated at this contact portion (developing portion). Here, a −250 to −400V DC voltage is applied to the developing roller 16 from a high voltage power supply (not illustrated), which is a developing voltage applying unit, and negatively charged toner is transferred from the developing roller 16 to the electrostatic latent image formed on the photosensitive drum 10. For the developing voltage, a bias generated by superimposing an AC component onto a DC component may be used.

Above the developing roller 16, the developing blade 17 (developer controlling member) is supported by the developer container. The developing blade 17 is disposed such that the tip thereof on the free end side contacts the outer peripheral surface of the developing roller 16 in the surface contact state.

In Example 1, the contacting direction of the developing blade 17 is a counter direction, that is, with respect this contact section, the edge side is located on the upstream side of the rotating direction of the developing roller 16. Further, in Example 1, the developing blade 17 contacts this elastic phosphor-bronze plate (0.1 mm thick) to the surface of the developing roller 16 at a predetermined linear pressure. By this developing blade 17, the developing blade 17 maintains the contact pressure to the developing roller 16, and the toner having negative chargeability is frictionally charged.

In Example 1, the developing apparatus 13, the photosensitive drum 10, which is rotary-driven, the charging roller 11, which uniformly charges the surface of the photosensitive drum 10, and the cleaning apparatus 14 are integrated into a frame, whereby the process cartridge 1 is constituted. The process cartridge for each color 1Y, 1M, 1C, and 1Bk can be detachably attached to the image forming apparatus main body 2 via an installation means included in the image forming apparatus main body 2. The cleaning apparatus 14 supports the cleaning blade, and the developing apparatus 13 supports the developing roller 16, the developing blade 17, and the toner supply roller 18. The process cartridge 1 is not limited to this arrangement. In other words, the process cartridge 1 can be any cartridge integrating at least one of the charging unit that charges the image bearing member, the developing unit that supplies developer to the photosensitive member, and the cleaning unit that cleans the image bearing member, and the image bearing member. Then, the process cartridge 1 is detachably attached to the image forming apparatus main body 2.

A cartridge memory 23 is attached to the process cartridge 1. The cartridge memory 23 includes a storage element M (not illustrated) to store data, and a memory control portion (not illustrated) that controls the reading and writing of data to/from the storage element M. The storage element M can be any non-volatile memory, such as a non-volatile random access memory (NVRAM), an electrically erasable programmable read-only memory, and a ferroelectric random access memory (FeRAM).

In this storage element M, the fixing performance information on the degree of performance of fixing the toner to the recording material S is stored as thermal characteristic information on the toner that is used for the process cartridge 1. The fixing performance of the toner is normally influenced by such factors as a transition temperature at which the material constituting the toner softens, a melt index (hereafter called MI), which indicates the flowability when the toner melts, and a particle size of the toner. For the fixing performance information that is written in the storage element M, information on these factors may be directly written, or a different fixing performance index that is comprehensively determined from these factors may be written.

A memory reading unit 24 is a reading portion to read the information of the cartridge memory 23 attached to the image forming apparatus main body 2. The memory reading unit 24 is directly connected with the CPU 60, which is a control portion of the image forming apparatus main body 2, and the fixing performance information stored in the cartridge memory 23 is read from the memory reading unit 24, and is then transferred to the CPU 60, so as to be reflected in the control of the image forming apparatus 100.

Features of Example 1

The configuration of Example 1 of the present invention will be described using an example when two levels of toners, having different fixing performance, are used for each color of the process cartridge 1 of the image forming apparatus 100.

In Example 1, the fixing performance dispersion generated during mass production of the toner of each color is classified into two levels. In other words, in each color, toner is classified into toner A if fixing performance thereof is relatively good, and toner B if fixing performance thereof is relatively poor. The dispersion of toner during mass production is generated by composite factors, such as dispersion of the particle size of the toner, dispersion of the MI of the toner, and dispersion of the temperature when the resin constituting the toner softens.

As a result of checking toner A and toner B of each color used in Example 1, the fixing performance of toner A and that of toner B were different by 20° C. in all the colors in terms of the fixing temperature of the thermal fixing apparatus. Here, the fixing performance was checked by observing the density decrease rate of the half-tone patch density. In concrete terms, a half-tone patch image (5 mm×5 mm), in which the density of a reflection densitometer (XRite) becomes 0.7 at each color, is printed at various target temperatures, and is then rubbed with a lens cleaning paper (made by Ozu Corp.), and the density decrease rate at this time is checked.

A process cartridge (hereafter called "cartridge") in which the toner A is filled, and that in which the toner B is filled are provided for each color of Y (yellow), M (magenta), C (cyan), and Bk (black). In other words, for color Y, a cartridge in which toner A is filled is provided as cartridge 1Ya, and a cartridge in which toner B is filled is provided as cartridge 1Yb. In the same manner, 1Ma and 1Mb are provided for color M, 1Ca and 1Cb are provided for color C, and 1Bka and 1Bkb are provided for color Bk. Further, the respective cartridge memories 23 store information indicating which one of toner A and toner B is in the cartridge.

Since each of the four colors has two levels of toners, there are sixteen combinations of cartridges. In Example 1, when the thermal fixing condition is switched, a fixing target temperature is set considering the combination of the cartridges, so that an optimum fixing performance can be implemented in accordance with the combination. Concrete configurations and effects will be described with reference to Table 1 and Table 2.

The fixing target temperature is determined as in Table 1, depending on the combination of the cartridges. After dedicated research by the inventors of the present invention, the inventors discovered that the color of the lowest layer (located in a position directly contacting the paper surface), out of the colors of the unfixed image formed on the sheet by the image forming apparatus 100 of the present invention, is a color that is most sensitive to the fixing performance, that is, a color black is a color that is most sensitive to the fixing performance. In other words, out of each toner of Y (yellow), M (magenta), C (cyan), and Bk (black), the color of the toner of which toner image is transferred last to the intermediate transfer belt 22 is the color that is most sensitive to the fixing performance. If the image forming apparatus 100 has a configuration to transfer a toner image directly to a recording material without using the intermediate transfer member 22, unlike Example 1, the color of the toner of which toner image is transferred first to the recording material, out of each toner, is the toner that is most sensitive to the fixing performance. Therefore, black toner is determined first, as shown in Table 1.

In other words, as a rule (except for some combinations), if toner A is used for black, the fixing target temperature is set to a temperature at the lower side (toner A side) in the 20° C. fixing temperature difference between toner A and toner B. If toner B is used for black, on the other hand, (except in some combinations), the fixing target temperature is set to a temperature at the higher side (toner B side). Y (yellow) does not stand out. Hence, the influence of Y on the fixing target temperature is set relatively low. M (magenta) and C (cyan) stand out more than Y when cold offset or hot offset is generated, although not as much as black. Hence, the influence of M and C on the fixing target temperature is set lower than black but higher than Y.

TABLE 1

| | Determination Method | Name | Temperature (° C.) |
|---|---|---|---|
| 1 | (All A) or (only Y is B, and others are A) | Low1 | 190 |
| 2 | (Black is A, and either M or C is B) | Low 2 | 194 |
| 3 | (Black and Y are A, and M and C are B) or (black is B and others are A) | Mid1 | 198 |
| 4 | (Black and Y are B, and M and C are A) or (black is A and others are B) | Mid2 | 202 |
| 5 | (Black is B, and either M or C is A) | High 1 | 206 |
| 6 | (All B) or (only Y is A, and others are B) | High 2 | 210 |

In this way, if black is toner A, the fixing target temperature is within the range of 190° C. to 198° C., except in case 4 of Table 1. If black is toner B, on the other hand, the fixing target temperature is within the range of 202° C. to 210° C., except in case 3 of Table 1.

Figure 3:
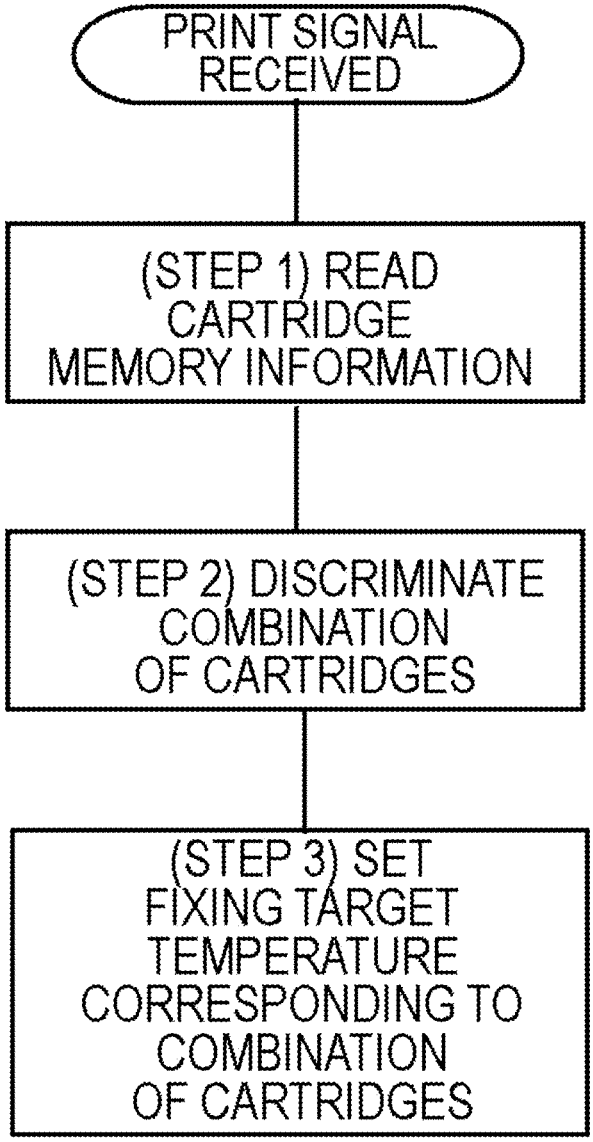
FIG. 3 is a flow chart to determine the fixing target temperature of Example 1.
Figure 9:
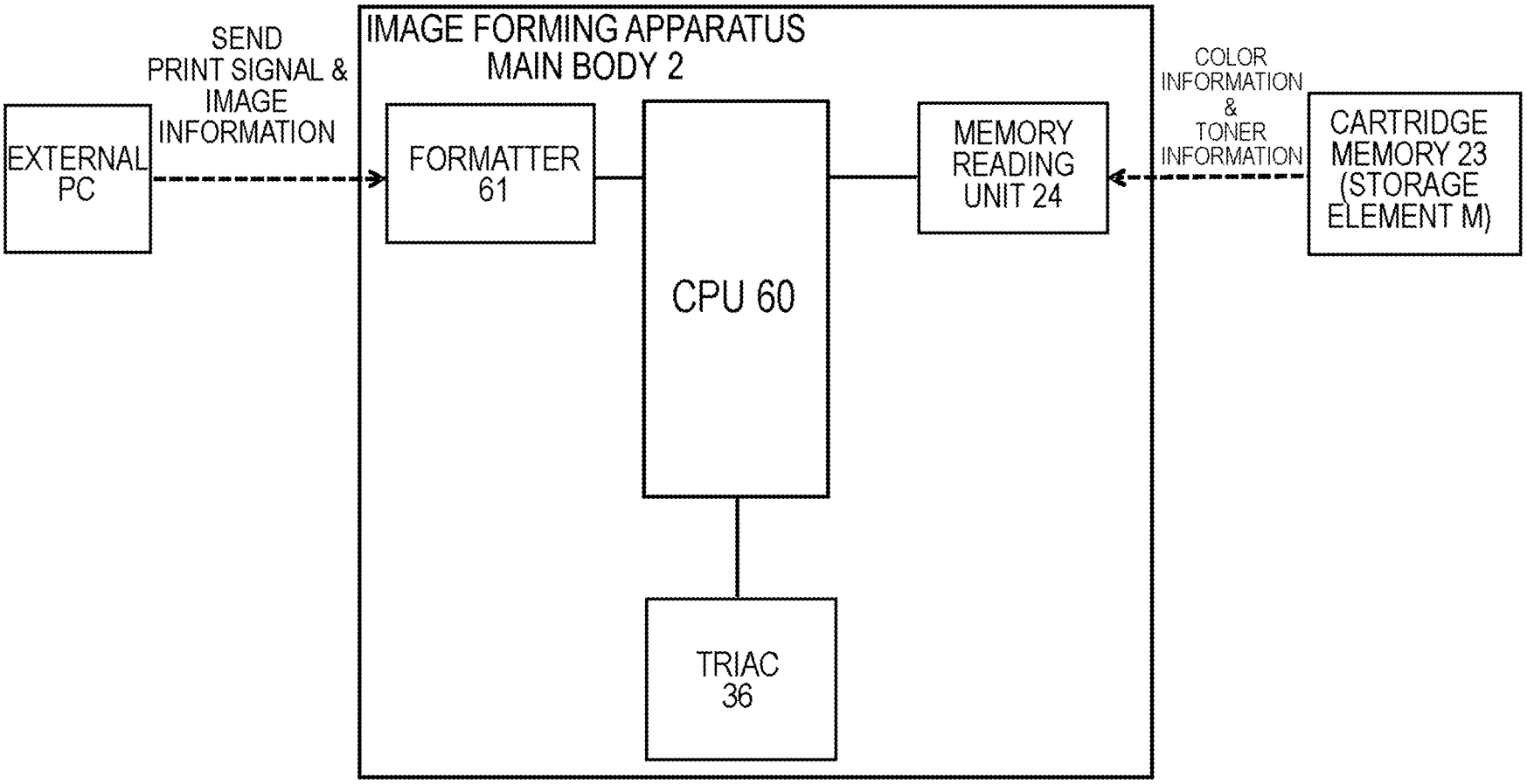
FIG. 9 is a block diagram of Example 1.

FIG. 3 is a flow chart to determine the fixing target temperature in the image forming apparatus of Example 1. FIG. 9 is a block diagram depicting a relationship among the control portion 60 of the image forming apparatus main body 2 of Example 1, the cartridge memory 23, the memory reading unit 24, and the triac 36. First, when a print signal and image information are sent from an external PC to the control portion CPU 60 of the main body via the formatter 61, the CPU 60 reads the information of the cartridge memory 23 using the memory reading unit 24 (step 1 in FIG. 3). Then, the CPU 60 determines, for each color, whether the toner in the cartridge that was read is toner A or toner B, so as to determine the combination of the cartridges (step 2 in FIG. 3). Further, the CPU 60 sets the fixing target temperature in accordance with the discriminated combination of the cartridges (step 3 in FIG. 3). Then the CPU 60 controls the power supply to the fixing apparatus 30 via the triac 36, and controls the fixing target temperature to a predetermined temperature, so as to perform the thermal fixing processing in accordance with the combination of the cartridges.

Comparative Example 1

The fixing target temperature is determined in the same way regardless of the combination of the cartridges. The fixing target temperature is set to Low 1 (190° C.), which is the temperature of toner B (lower limit temperature).

Comparative Example 2

The fixing target temperature is determined in the same way regardless of the combination of the cartridges. The fixing target temperature is set to High 2 (210° C.), which is the temperature of toner A (upper limit temperature).

Comparative Example 3

The target temperature is determined in the same way regardless of the combination of the cartridges. The target temperature is an intermediate temperature (Mid: 200° C.) between the upper limit temperature (High 2: 210° C.), and the lower limit temperature (Low 1: 190° C.).

Table 2 shows the list of relationships between the concrete combination of cartridges and the target temperature of Example 1, Comparative Example 1, Comparative Example 2, and Comparative Example 3.

TABLE 2

| | | | | | Temperature Control | | | |
|---|---|---|---|---|---|---|---|---|
| Case No. | Y | M | C | K | Example 1 | Comparative Example 1 | Comparative Example 2 | Comparative Example 3 |
| 1 | A | A | A | A | Low1 | Low1 | High2 | Mid |
| 2 | B | A | A | A | Low1 | ↑ | ↑ | ↑ |
| 3 | A | B | A | A | Low2 | ↑ | ↑ | ↑ |
| 4 | A | A | B | A | Low2 | ↑ | ↑ | ↑ |
| 5 | B | B | A | A | Low2 | ↑ | ↑ | ↑ |
| 6 | B | A | B | A | Low2 | ↑ | ↑ | ↑ |
| 7 | A | B | B | A | Mid1 | ↑ | ↑ | ↑ |
| 8 | B | B | B | A | Mid2 | ↑ | ↑ | ↑ |
| 9 | B | B | B | B | High2 | ↑ | ↑ | ↑ |
| 10 | A | B | B | B | High2 | ↑ | ↑ | ↑ |
| 11 | B | A | B | B | High1 | ↑ | ↑ | ↑ |
| 12 | B | B | A | B | High1 | ↑ | ↑ | ↑ |
| 13 | A | A | B | B | High1 | ↑ | ↑ | ↑ |
| 14 | A | B | A | B | High1 | ↑ | ↑ | ↑ |
| 15 | B | A | A | B | Mid2 | ↑ | ↑ | ↑ |
| 16 | A | A | A | B | Mid1 | ↑ | ↑ | ↑ |

Images were actually printed using the respective configurations of Example 1, Comparative Example 1, Comparative Example 2, and Comparative Example 3, shown in Table 2, and the fixing performance of each case was compared. Table 3 shows the test results.

For the testing method, five sheets of A4 sized paper (80 g standard paper) were continuously printed from a cold start using test images (set of five A4 sized images) based on the ISO/IEC 19798 standard at room temperature and normal humidity (20° C., 55%), and the fixing performance of each sheet was checked. O in Table 3 indicates that neither a hot offset nor a cold offset was generated. OΔ indicates that a slight hot offset was generated, and the level of hot offset generation increases in the sequence of Δ, ΔX, and X. OΔ indicates that a slight cold offset was generated, and the level of generation of cold offset increases in the sequence of Δ, ΔX and X.

TABLE 3

| | | | | | Fixing Performance Testing Result | | | |
|---|---|---|---|---|---|---|---|---|
| Case No. | Y | M | C | K | Example 1 | Comparative Example 1 | Comparative Example 2 | Comparative Example 3 |
| 1 | A | A | A | A | ○ | ○ | x | Δx |
| 2 | B | A | A | A | ○ | ○ | x | Δ |
| 3 | A | B | A | A | ○ | ○Δ | x | ○Δ |
| 4 | A | A | B | A | ○ | ○Δ | x | ○Δ |
| 5 | B | B | A | A | ○Δ | ○Δ | Δx | ○Δ |
| 6 | B | A | B | A | ○Δ | ○Δ | Δx | ○Δ |
| 7 | A | B | B | A | ○ | Δ | Δ | ○ |
| 8 | B | B | B | A | ○ | Δ | Δ | ○ |
| 9 | B | B | B | B | ○ | x | ○ | Δx |
| 10 | A | B | B | B | ○ | x | ○ | Δ |
| 11 | B | A | B | B | ○ | x | ○Δ | ○Δ |
| 12 | B | B | A | B | ○ | x | ○Δ | ○Δ |
| 13 | A | A | B | B | ○Δ | Δx | ○Δ | ○Δ |
| 14 | A | B | A | B | ○Δ | Δx | ○Δ | ○Δ |
| 15 | B | A | A | B | ○ | Δ | Δ | ○ |
| 16 | A | A | A | B | ○ | Δ | Δ | ○ |

As the results in Table 3 show, according to the configuration of Example 1, a cold offset and hot offset are generated in some combinations, but all of these offsets are quite minor.

In Comparative Example 1, on the other hand, a cold offset was generated in all combinations except in the case of using an A cartridge for all colors (in the case of 1), and in the case of using a B cartridge only for Y (in the case of 2). Additionally, in Comparative Example 1, the level of the cold offset tends to increase as the number of colors for which the B cartridge is used increases.

In Comparative Example 2, a hot offset was generated in all combinations except in the case of using the B cartridge for all colors (in the case of 9), and in the case of using the A cartridge only for Y (in the case of 10). Additionally, in Comparative Example 2, the level of generation of a hot offset tends to increase as the number of colors for which the A cartridge is used increases.

In Comparative Example 3, a cold offset or a hot offset was generated, of which level is not as high as Comparative Example 1 or Comparative Example 2, but is not as low as Example 1.

Example 2

In Example 1, the fixing target temperature is set considering only the color combination of the cartridges using toner A and toner B, without determining the colors used for the print image. In Example 2 of the present invention, on the other hand, the fixing target temperature is set not only in accordance with the combination of the cartridges using toners having different fixing performances, but also colors used for the image are taken into consideration. Thereby, an image forming apparatus that can further prevent the generation of a cold offset and a hot offset can be implemented.

A basic hardware configuration (image forming apparatus configuration, cartridge configuration, toner configuration) of Example 2 is the same as Example 1. The difference is that when a specific combination of cartridges is determined, the fixing target temperature of the image is corrected by also referring to the color information (density information) of the print image, and, therefore, the formatter 61 plays a role of an image information discriminating portion that discriminates the image information. The concrete configuration and effect of Example 2 will now be described. The rest of the configuration is the same as Example 1.

Figure 4:
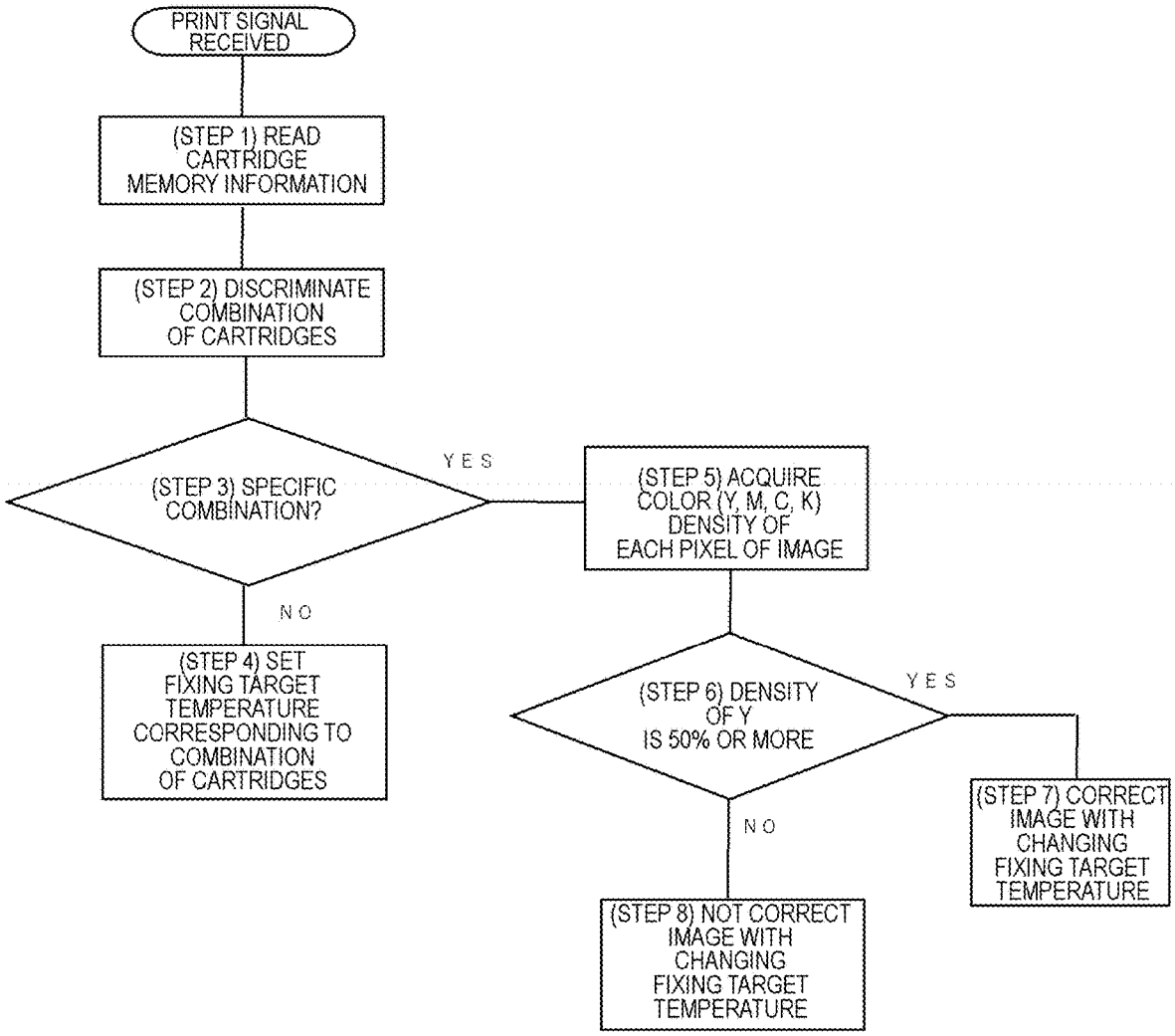
FIG. 4 is a flow chart to determine the fixing target temperature of Example 2.
Figure 10:
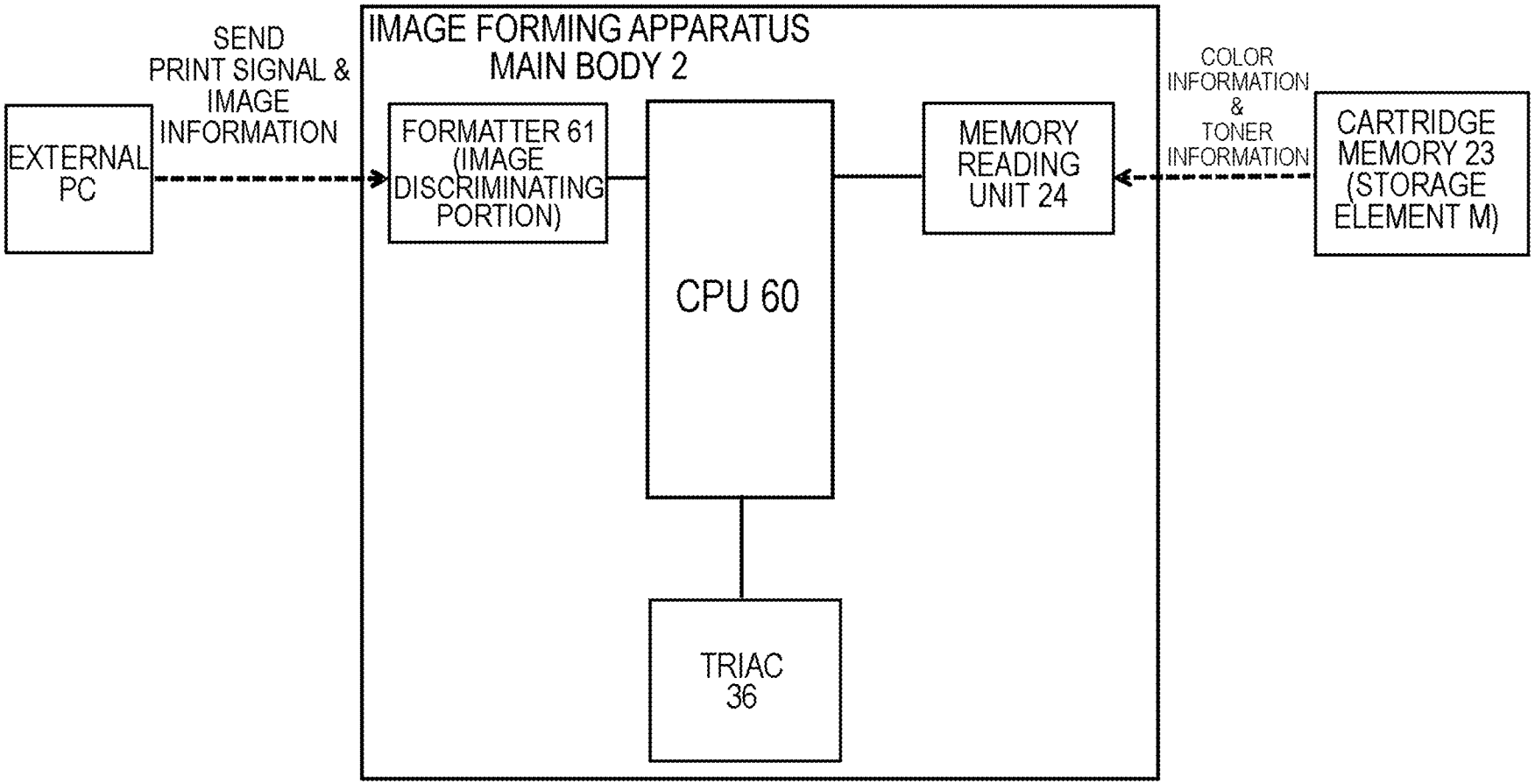
FIG. 10 is a block diagram of Example 2.
Figure 11:
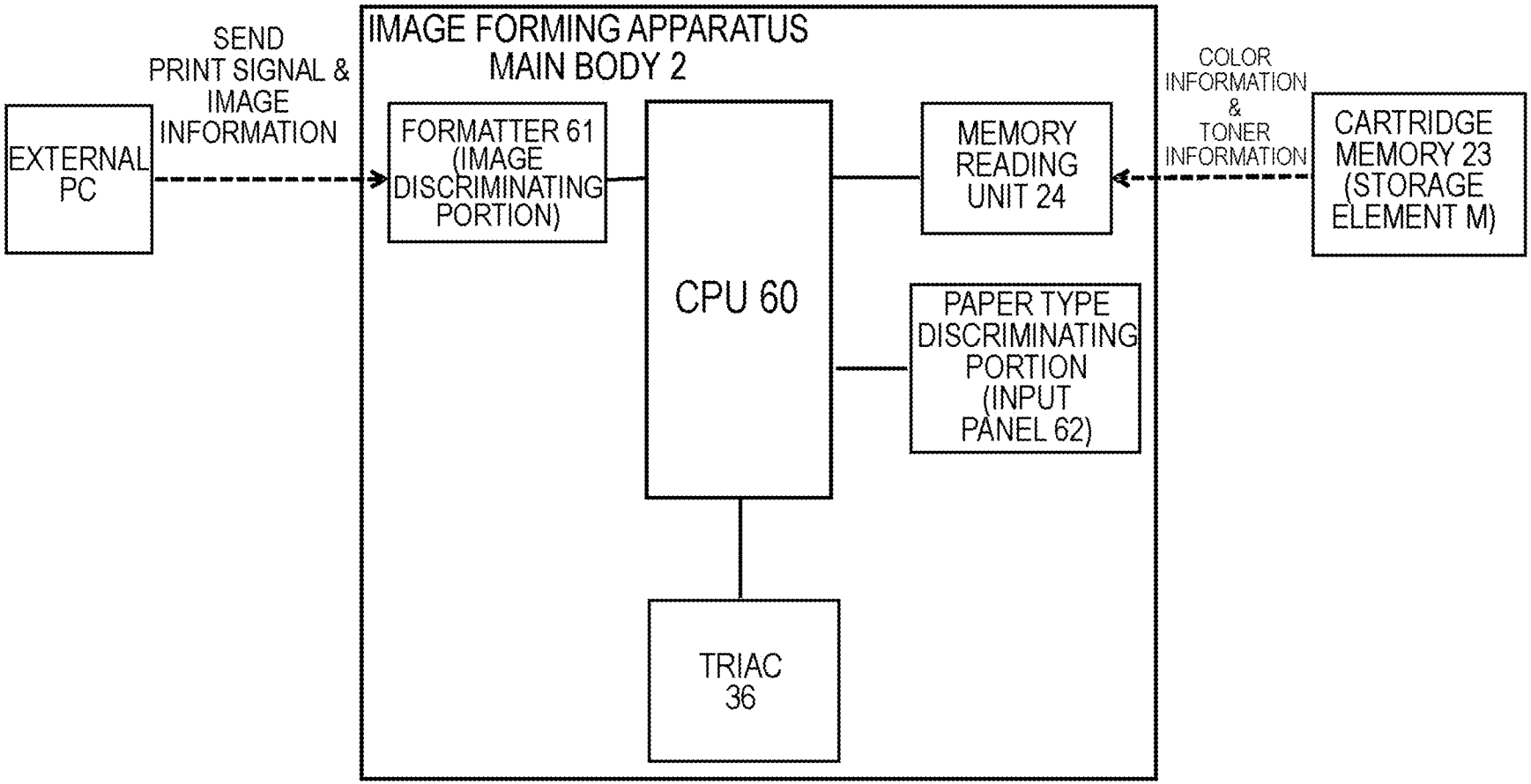
FIG. 11 is a block diagram of Example 3.

FIG. 4 is a flow chart to determine the fixing target temperature in the image forming apparatus of Example 2. FIG. 10 is a block diagram depicting relationships among the control portion 60 of the image forming apparatus main body 2 of Example 2, the cartridge memory 23, the memory reading unit 24, the formatter (image information discriminating portion) 61, and the triac 36. First, when a print signal and image information are sent form an external PC to the control portion CPU 60 of the main body via the formatter 61, the CPU 60 reads information of the cartridge memory 23 using the memory reading unit 24 (step 1 in FIG. 4). Then the CPU 60 determines, for each color, whether the toner in the cartridge that was read is toner A or toner B, so as to determine the combination of the cartridges (step 2 in FIG. 4). Further, the CPU 60 determines whether this combination is a specific combination (step 3 in FIG. 4). If this combination is a specific combination, processing advances to step 5 in FIG. 4, and if not, the fixing target temperature corresponding to this combination is determined in accordance with Table 4 (step 4 in FIG. 4).

TABLE 4

| Case No. | Y | M | C | K | Temperature Control Example 2 |
|---|---|---|---|---|---|
| 1 | A | A | A | A | Low1 |
| 2 | B | A | A | A | Low1 |
| 3 | A | B | A | A | Low2 |
| 4 | A | A | B | A | Low2 |
| 5 | B | B | A | A | Low2 + image correction |
| 6 | B | A | B | A | Low2 + image correction |
| 7 | A | B | B | A | Mid1 |
| 8 | B | B | B | A | Mid2 |
| 9 | B | B | B | B | High2 |
| 10 | A | B | B | B | High2 |
| 11 | B | A | B | B | High1 |
| 12 | B | B | A | B | High1 |
| 13 | A | A | B | B | High1 + image correction |
| 14 | A | B | A | B | High1 + image correction |
| 15 | B | A | A | B | Mid2 |
| 16 | A | A | A | B | Mid1 |

In Table 4, the concrete target temperatures indicated by Low 1, Low 2, Mid 1, Mid 2, High 1, and High 2 are the same as Example 1 indicated in Table 1.

A specific combination is Nos. 5, 6, 13, or 14 in Table 4. In the case of these combinations, the print image is further determined and the image correction to correct the fixing target temperature is performed. This image correction to correct the fixing target temperature is different in Example 2 from Example 1.

If the CPU 60 determines in step 3 in FIG. 4 that the cartridge combination in the image forming apparatus 100 is the specific combination, the CPU 60 acquires the image information on the Y color density in the print image from the formatter 61 (step 5 in FIG. 4).

For the Y color density (density information on yellow toner), the formatter 61 detects the maximum density of the Y color out of the pixels constituting the print image when the print image is converted into the four colors: Y, M, C and Bk. Then the CPU 60 determines whether this maximum density is 50% or more (step 6 in FIG. 4), and, if YES, the image correction to correct the fixing target temperature is performed in accordance with the following Table 5 (step 7 in FIG. 4), and, if NO, the image correction to correct the fixing target temperature is not performed (step 8 in FIG. 4).

TABLE 5

| Case No. | Y | M | C | K | Correction Method |
|---|---|---|---|---|---|
| 5 | B | B | A | A | Increase 3° C. if Y is 50% or more |
| 6 | B | A | B | A | Increase 3° C. if Y is 50% or more |
| 13 | A | A | B | B | Decrease 3° C. if Y is 50% or more |
| 14 | A | B | A | B | Decrease 3° C. if Y is 50% or more |

This temperature control correction is performed for the specific combinations Nos. 5, 6, 13, and 14 in Table 4 because the fixing performance differs depending on the density of Y in the case of these combinations. For example, in the case of the combination type 5 or 6 in Table 4, Low 2 temperature control is performed according to Example 1, but, in this case, a slight cold offset is generated in a portion in which the density of Y is relatively high. This tendency is not observed in the case of using the B cartridge only for Y (e.g. No. 2 in Table 4), but it is observed only in the case of using the B cartridge for M or C as well in addition to Y. This is probably because the case of using the B cartridge only for Y has a relatively wide margin regarding the generation of a cold offset, as compared with the case of using the B cartridge not only for Y, but also for M or C. Occurrence of variation at the density of at least 50% is because, compared with other colors, Y does not stand out very much when an offset is generated. If Y is less than 50%, Y is not visually recognized very much, even if offset toner exists, and this problem is visually recognized only when the density of Y reaches 50% or more.

The relationship of Y to a hot offset also shows the exact same tendency. In other words, in the case of the combination 13 or 14 in Table 4, a slight hot offset is generated in a portion in which the density of Y is relatively high. This tendency is not observed in the case of using the A cartridge only for Y (e.g. No. 2 in Table 4), but is observed only in the case of using the A cartridge for M or C as well in addition to Y.

Table 6 shows the result when the images were actually printed using the configuration of Example 2.

TABLE 6

| Case No. | Y | M | C | K | Fixing Performance Testing Result Example 2 |
|---|---|---|---|---|---|
| 1 | A | A | A | A | O |
| 2 | B | A | A | A | O |
| 3 | A | B | A | A | O |
| 4 | A | A | B | A | O |
| 5 | B | B | A | A | O |
| 6 | B | A | B | A | O |
| 7 | A | B | B | A | O |
| 8 | B | B | B | A | O |
| 9 | B | B | B | B | O |
| 10 | A | B | B | B | O |
| 11 | B | A | B | B | O |
| 12 | B | B | A | B | O |
| 13 | A | A | B | B | O |
| 14 | A | B | A | B | O |
| 15 | B | A | A | B | O |
| 16 | A | A | A | B | O |

The testing method that was used is the same as Example 1. In other words, five sheets of A4 sized paper (80 g standard paper) were continuously printed from a cold start using test images (set of five A4 sized images) based on the ISO/IEC 19798 standard at room temperature and normal humidity (20° C., 55%), and the fixing performance of each sheet was checked. O in Table 6 indicates that neither a heater hot offset nor a cold offset was generated.

As Table 6 shows, the generation of a hot offset or a cold offset was not observed for all cases in Example 2, and a result even better than Example 1 was implemented.

In Example 2, the fixing target temperature is corrected based on the print images for Nos. 5, 6, 13, and 14 out of the combinations in Table 4, but needless to say, the combination for which the print image is considered to determine the fixing target temperature is not limited to these combinations. For example, if the image detecting unit detected that Y is not used during checking the density of the print image when the combination of the cartridges is No. 2 in Table 4, then the target temperature setting may be decreased from Low 2 to Low 1. Further, in Example 2, only the density of Y in the print image is detected and reflected to the fixing target temperature, but the present invention is not limited to such a configuration. For example, if the density of another color is sensitive to a hot offset or a cold offset, the density of this color in the print image may be determined and reflected to the fixing target temperature.

Example 3

In Example 1 and Example 2, the paper type is not considered, but in Example 3 of the present invention, a paper type discriminating portion, which determines the paper type used for the printing, is disposed, so that the paper type is determined in addition to the combination of cartridges using toners having different fixing performances, to set the fixing target temperature. Thereby, image sticking, which is generated when a combination of cartridges using toner having a specific fixing performance is used with a specific paper type, is prevented.

A basic hardware configuration (image forming apparatus configuration, cartridge configuration, toner configuration) of Example 3 is the same as Example 1. More specifically, however, Example 3 is the same as Example 1 except for the aspect described herein below. Example 3 has a gloss paper mode, which is a dedicated mode to print special paper having a surface that is smoothed (hereafter called "gloss paper") so as to acquire high gloss. To print an image on gloss paper in the gloss paper mode, the user selects "gloss paper" for the print paper type using an input panel, which is the paper type discriminating portion (recording material discriminating portion), disposed in the image forming apparatus main body 2. When this gloss paper mode is selected before printing, the image forming apparatus 100 performs printing at a reduced processing speed of 33 mm/sec, which is ⅓ the regular speed.

Gloss paper normally has a basis weight of 100 g/m$^2$ or more, and requires more heat for fixing. Therefore, the image forming apparatus 100 reduces the process speed and sets the throughput (TP) to be less than that of standard paper, so that toner can be fixed to gloss paper by slow heating. An image printed on gloss paper has higher gloss than standard paper because of the high smoothness of gloss paper. The paper easily sticks together, however, because of the high smoothness of the paper, and, once paper is heated, it does not cool down quickly because the basis weight is high. Hence, if a large amount of printed gloss paper is stacked in the paper delivery tray 37 during continuous printing, sticking tends to be generated. Sticking is a phenomenon in which the toner image fixed on the paper that is stacked in the paper delivery tray 37 sticks to the adjacent paper, the toner image smudges off, and the image is marred.

In Example 3, the throughput of the gloss paper is basically set to 5 ppm (pages per minute, or the number of pages of recording material that can be discharged per minute), but the throughput is decreased to prevent sticking if a specific combination of cartridges is detected. By decreasing the throughput, the space between sheets (conveyance interval of recording materials that are thermally fixed continuously) increases, and the time interval between sheets that are stacked in the paper delivery tray 37 increases, and as a result, the temperature of the stack of paper does not increase very much, and the generation of sticking can be suppressed.

Now Embodiment 1 and Embodiment 2, which are actual configurations of Example 3, will be described in sequence.

Embodiment 1 of Example 3

Figure 5:
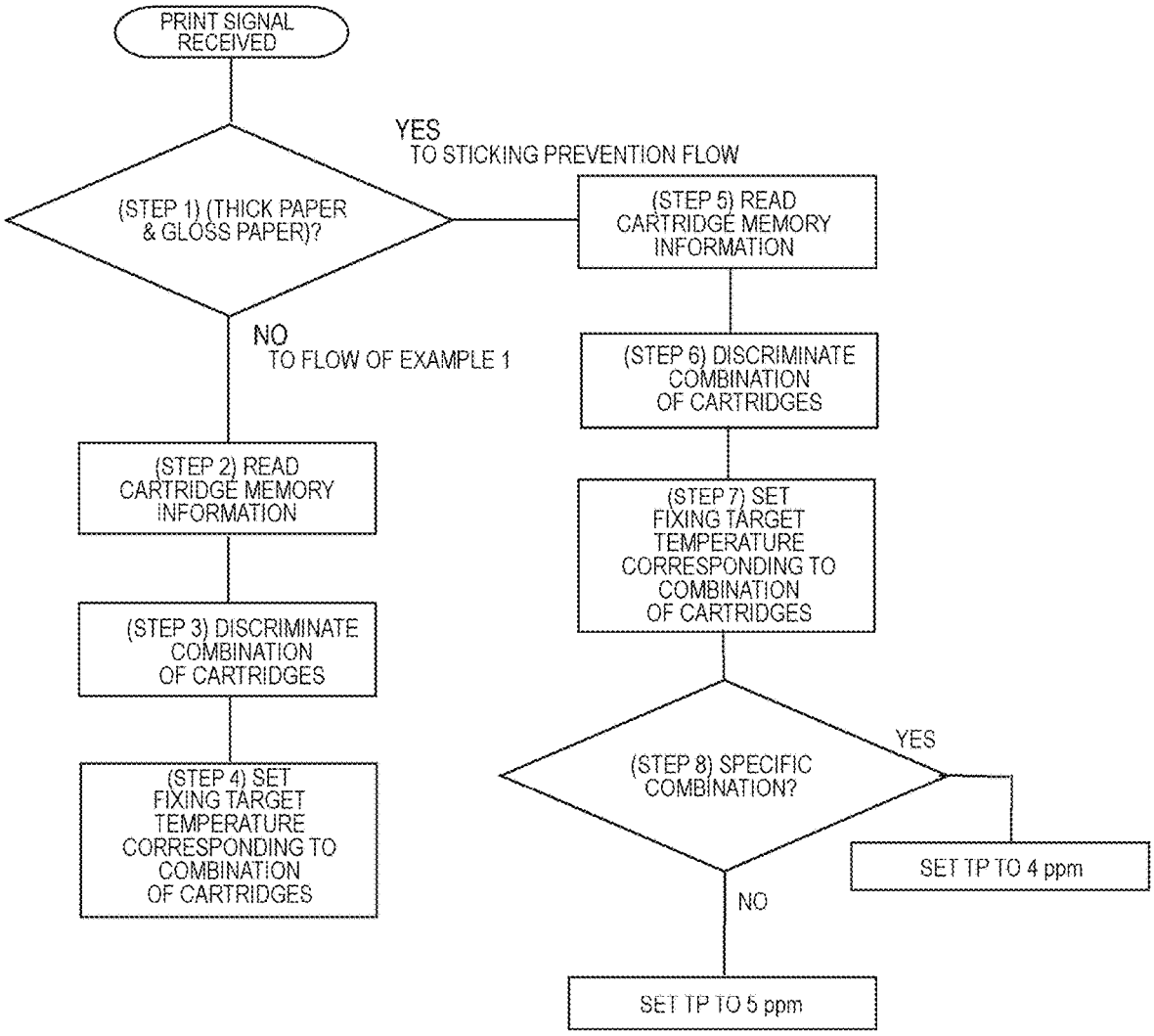
FIG. 5 is a flow chart to determine the fixing target temperature and the throughput of Embodiment 1 of Example 3.

FIG. 5 is a flow chart to determine the fixing target temperature and to determine the throughput according to Embodiment 1 of Example 3 of the present invention. FIG.

11 is a block diagram depicting the relationships among the control portion 60 of the image forming apparatus main body 2 of Example 3, the cartridge memory 23, the memory reading unit 24, the formatter (image information discriminating portion) 61, the input panel (paper type discriminating portion), and the triac 36. First, when a print signal and the image information are sent from an external PC to the control portion CPU 60 of the main body via the formatter 61, the CPU 60 determines whether the print mode is gloss paper mode (step 1). If it is determined that the print mode is not gloss paper mode, step 2 to step 4 are executed in the same manner as Example 1, but, if it is gloss paper mode, the control to prevent sticking in step 5 and later is executed.

In step 5, the CPU 60 reads the information in the cartridge memory 23 using the memory reading unit 24. Then, in step 6, the CPU 60 determines, for each color, whether the toner in the cartridge that was read is toner A or toner B, so as to determine the combination of the cartridges. After determining the combination, the CPU 60 determines the corresponding fixing target temperature setting in accordance with Table 7.

TABLE 7

| Case No. | Y | M | C | K | Fixing Target Temperature Setting Example 3 (Embodiment 1 & Embodiment 2) |
|---|---|---|---|---|---|
| 1 | A | A | A | A | G - Low1 |
| 2 | B | A | A | A | G - Low1 |
| 3 | A | B | A | A | G - Low2 |
| 4 | A | A | B | A | G - Low2 |
| 5 | B | B | A | A | G - Low2 |
| 6 | B | A | B | A | G - Low2 |
| 7 | A | B | B | A | G - Mid1 |
| 8 | B | B | B | A | G - Mid2 |
| 9 | B | B | B | B | G - High2 |
| 10 | A | B | B | B | G - High2 |
| 11 | B | A | B | B | G - High1 |
| 12 | B | B | A | B | G - High1 |
| 13 | A | A | B | B | G - High1 |
| 14 | A | B | A | B | G - High 1 |
| 15 | B | A | A | B | G - Mid2 |
| 16 | A | A | A | B | G - Mid1 |

Table 8 shows a concrete relationship between each target temperature setting name in Table 7 and the target temperatures.

TABLE 8

| Determination Method | Name | Temperature (° C.) |
|---|---|---|
| (All A) or (only Y is B, and others are A) | G - Low1 | 160 |
| (Black is A, and either M or C is B) | G - Low2 | 164 |
| (Black and Y are A, and M and C are B) or (black is B and others are A) | G - Mid1 | 168 |
| (Black and Y are B, and M and C are A) or (black is A and others are B) | G - Mid2 | 172 |
| (Black is B, and either M or C is A) | G - High1 | 176 |
| (All B) or (only Y is A, and others are B) | G - Mid2 | 180 |

The determination method for the target temperature in Example 3 is the same as Example 1, but only the temperature values are different in gloss paper mode, so that the toner is fixed to the gloss paper. When the fixing performance of toner A and that of toner B were actually tested for the same colors as Example 1 using the gloss paper (150 g/m$^2$, LTR), the fixing temperature of toner A was 160° C., and the fixing temperature of toner B was 180° C.

After determining the target temperature in step 7 according to Table 7, the throughput is determined. In other words, in step 8, it is determined whether the combination of the cartridges is a specific combination that is lax to prevent sticking. If the combination is such a specific combination shown in Table 9 (combinations 1-7 and 13-16 in Table 9), the throughput is set to 4 ppm instead of 5 ppm.

TABLE 9

| Case | Combination | | | | Throughput | | |
|---|---|---|---|---|---|---|---|
| | | | | | Comparative | Embodiment 1 | Embodiment 2 |
| No. | Y | M | C | K | Example 4 | of Example 3 | of Example 3 |
| 1 | A | A | A | A | | 4 ppm | 4 ppm |
| 2 | B | A | A | A | 5 ppm for all combinations | 4 ppm | 5 ppm image correction need |
| 3 | A | B | A | A | | 4 ppm | 5 ppm image correction need |
| 4 | A | A | B | A | | 4 ppm | 5 ppm image correction need |
| 5 | B | B | A | A | | 4 ppm | 5 ppm image correction need |
| 6 | B | A | B | A | | 4 ppm | 5 ppm image correction need |
| 7 | A | B | B | A | | 4 ppm | 5 ppm image correction need |
| 8 | B | B | B | A | | 5 ppm | 5 ppm image correction need |
| 9 | B | B | B | B | | 5 ppm | 5 ppm |
| 10 | A | B | B | B | 5 ppm for all combinations | 5 ppm | 5 ppm image correction need |
| 11 | B | A | B | B | | 5 ppm | 5 ppm image correction need |
| 12 | B | B | A | B | | 5 ppm | 5 ppm image correction need |
| 13 | A | A | B | B | | 4 ppm | 5 ppm image correction need |
| 14 | A | B | A | B | | 4 ppm | 5 ppm image correction need |
| 15 | B | A | A | B | | 4 ppm | 5 ppm image correction need |
| 16 | A | A | A | B | | 4 ppm | 5 ppm image correction need |

After dedicated research, the present inventors discovered that toner A has good fixing performance, and, therefore, it is lax to prevent sticking compared with toner B. In concrete terms, when the gloss paper (150 g/m$^2$, LTR) is fed at 5 ppm, sticking occurs if, out of the toner in the same pixel constituting the print image, the total density, when the density values of toner A of all colors added, is 150% or more. Therefore, a specific combination, which is lax to prevent sticking, is the case when at least secondary colors are used, and at least two A cartridges are used. Therefore, in Embodiment 1 of Example 3, as shown in Table 9, throughput is set to 5 ppm when all toner cartridges are B, and, when only one toner cartridge is A, and throughput is set to 4 ppm when two or more toner cartridges are A.

Embodiment 2 of Example 3

The hardware configurations and the fixing target temperature setting of Embodiment 2 of Example 3 are basically the same as Embodiment 1 of Example 3. The difference is that the throughput, when gloss paper mode is used, is determined based not only on the combination of the cartridges, but also on the print image that is detected. Therefore, the formatter 61 also plays the role of the image discriminating portion, just like Example 2.

As shown in Table 9, according to Embodiment 2 of Example 3, image discrimination to determine the throughput is performed except in the case when all the cartridges are A, and in the case when all cartridges are B.

Figure 6:
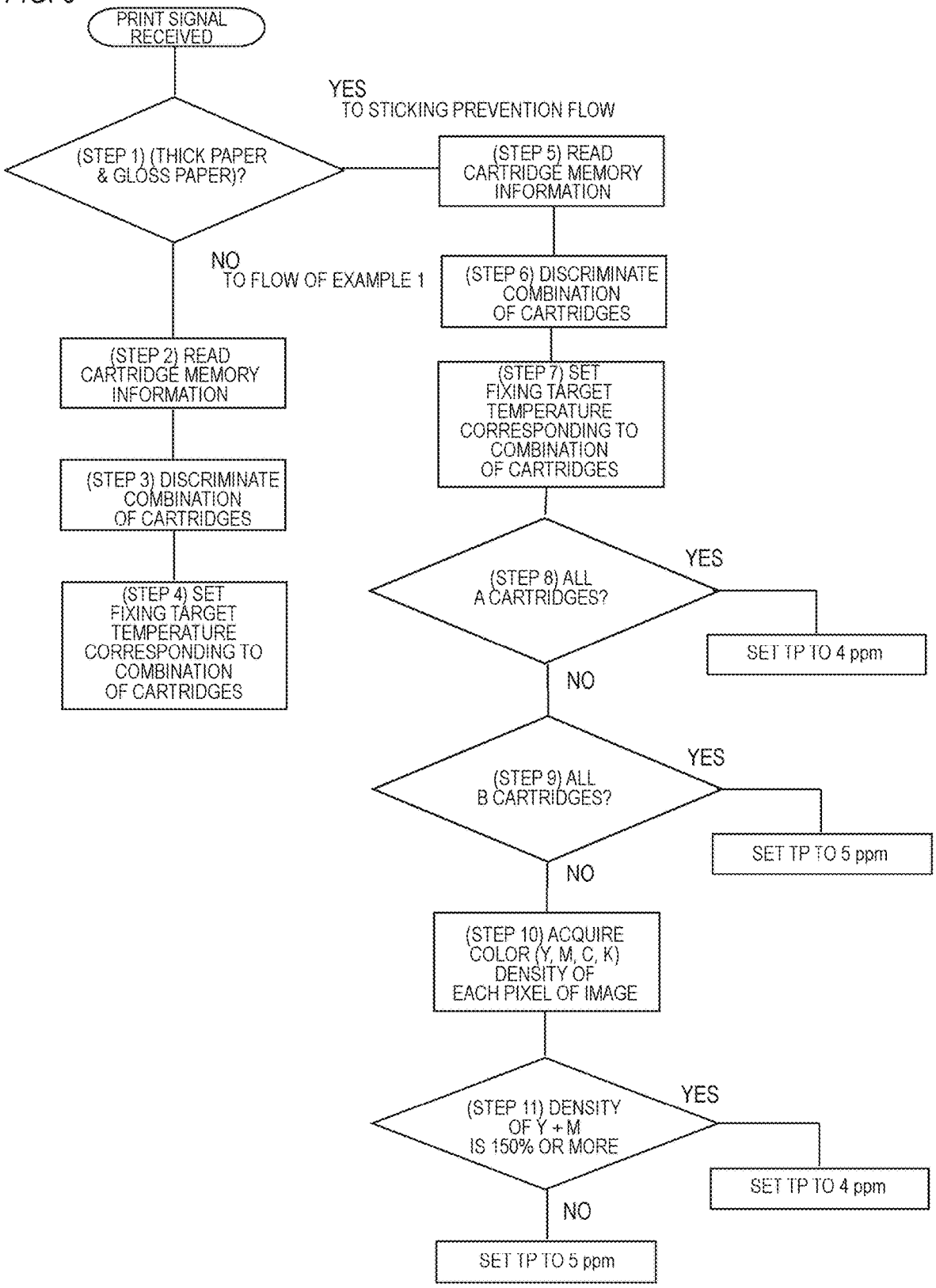
FIG. 6 is a flow chart to determine the fixing target temperature and the throughput of Embodiment 2 of Example 3.

FIG. 6 is a flow chart to determine the fixing target temperature and to determine the throughput according to Embodiment 2 of Example 3. First, when a print signal and image information are sent from an external PC to the control portion CPU 60 of the main body via the formatter 61, the CPU 60 determines whether the print mode is gloss paper mode (step 1). If it is determined that the print mode is not gloss paper mode, step 2 to step 4 are executed in the same manner as Example 1, but, if it is gloss paper mode, the control to prevent sticking in step 5 and later is executed.

In step 5, the CPU 60 reads the information in the cartridge memory 23 using the memory reading unit 24. Then, in step 6, the CPU 60 determines, for each color, whether the toner in the cartridge that was read is toner A or toner B, so as to determine the combination of the cartridges. After determining this combination, the CPU 60 determines the corresponding fixing target temperature setting in accordance with Table 7.

After determining the fixing target temperature in accordance with Table 7 in step 7, the CPU 60 determines the throughput. In other words, in step 8, the CPU 60 discriminates whether all cartridges in the combination are A, and sets the throughput to 4 ppm if YES. Then, in step 9, the CPU 60 discriminates whether all cartridges are B, and sets the throughput to 5 ppm if YES.

If the combination of the toner cartridges is neither all A nor all B, then the CPU 60 discriminates the print image in step 10. In other words, the CPU 60 checks the density of toner A in the print image.

In step 10, the CPU 60 detects the total density of only the colors using the A cartridge in one pixel based on the information when the formatter 61 (image discriminating portion) converted the print image into four colors: Y, M, C and Bk. The CPU 60 sets the throughput to 4 ppm if it is determined that this total density is 150% or more. The CPU 60 sets the throughput to 5 ppm if it is determined that this total density is less than 150%.

Comparative Example 4

The hardware configuration of Comparative Example 4 is the same as the configuration of Embodiment 1 of Example 3. The difference is that the throughput in gloss paper mode is set to 5 ppm for all the combinations of the cartridges shown in Table 9.

Table 10 shows an actual testing result when gloss paper (150 g/m$^2$, LTR) was continuously printed in each gloss paper mode using the configurations of Embodiment 1 of Example 3, Embodiment 2 of Example 3, and Comparative Example 4, and sticking was checked.

Figure 7:
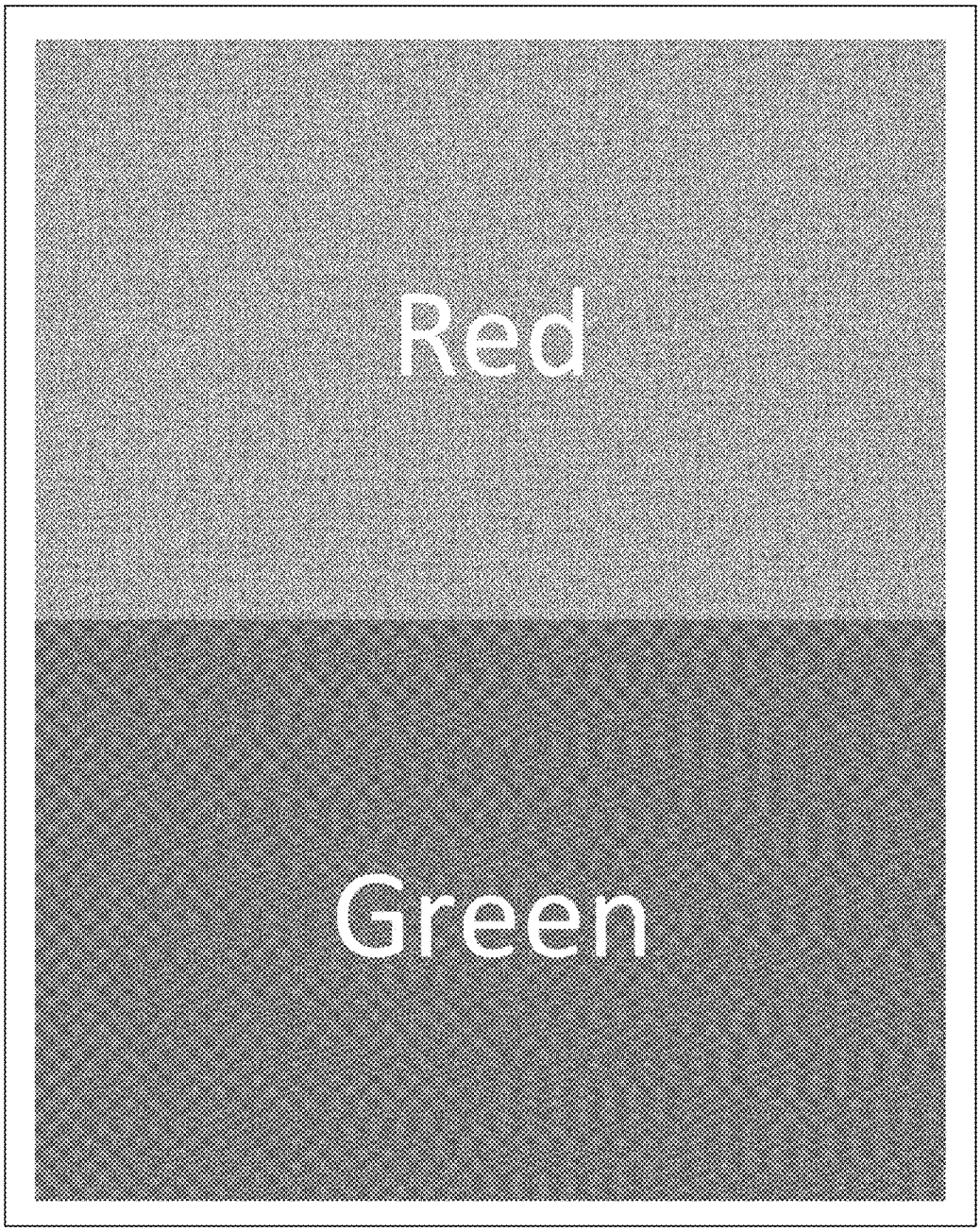
FIG. 7 shows a test image 1.
Figure 8:
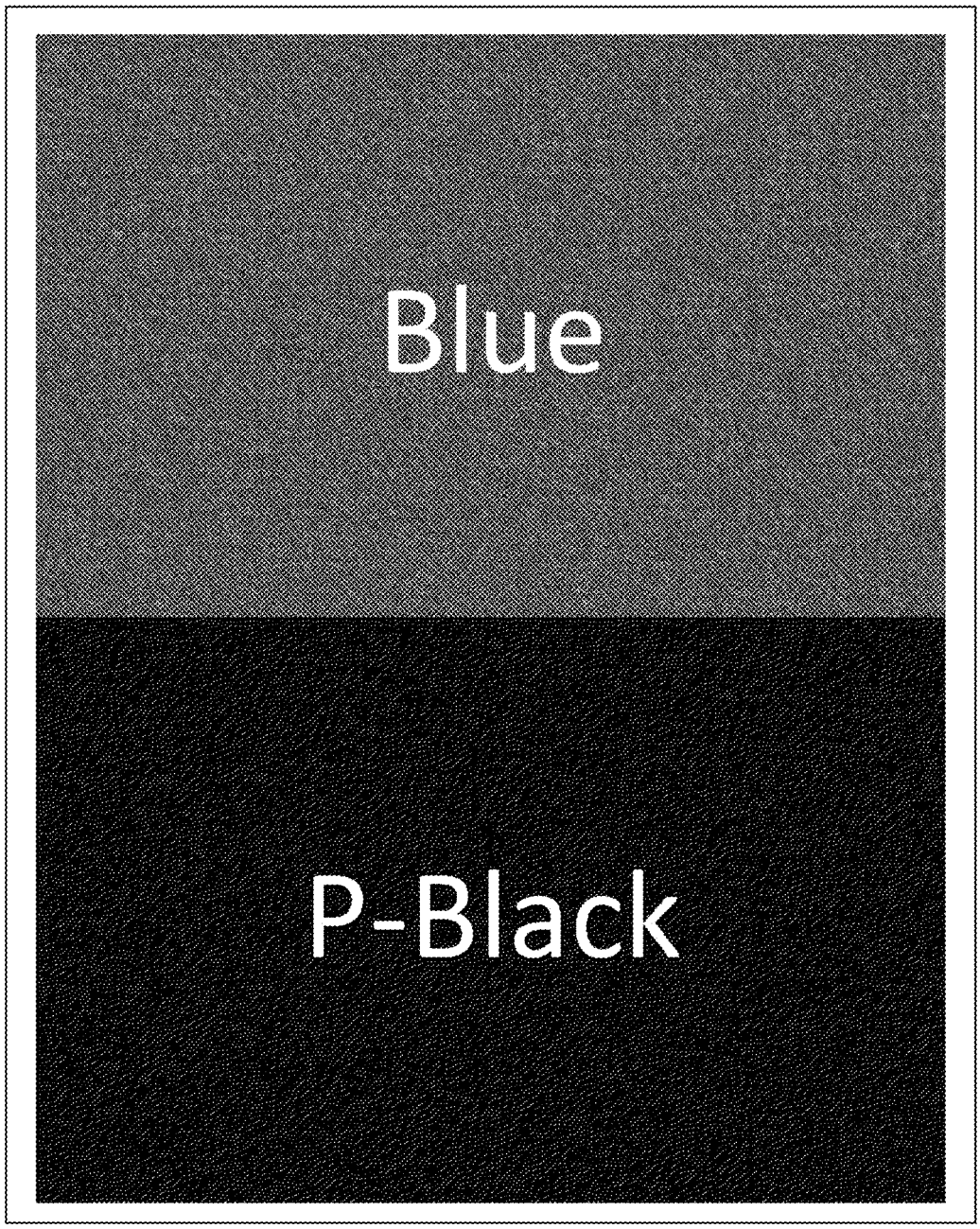
FIG. 8 shows a test image 2.

Testing was performed twice: once for each of the two types of images shown in FIG. 7 and FIG. 8. For test image 1, the solid image in FIG. 7 was used. In other words, in a LTR sheet, this is a solid image having an upper half of the image region, excluding the 5 mm margins on both the left and right ends and the 5 mm margins on both the top and bottom ends, that is red, and a lower half thereof that is green. Red is a 160% secondary color of which yellow is 80% and magenta is 80%, and green is a 160% secondary color of which yellow is 80% and magenta is 80%. For the test image 2, the solid image in FIG. 8 was used. In other words, in a LTR sheet this is a solid image having an upper half of the image region, excluding the 5 mm margins on both the left and right ends and the 5 mm margins on both the top and bottom ends, that is blue, and a lower half thereof that is process black (P-Black). Blue is a 160% secondary color of which magenta is 80% and cyan is 80%, and process black is a 160% quaternary color of which yellow is 20%, magenta is 20%, cyan is 20%, and black is 100%.

The first test is performed using the print image 1 in FIG. 7, and the second test is performed by changing the print image to the print image 2 in FIG. 8. For the testing method, fifty sheets of single sided continuous printing was performed for each of the above mentioned images from a cold start in a room temperature environment (i.e., a state in which the fixing apparatus 30 is sufficiently accustomed to the room temperature environment), and sticking was checked when fifty sheets were stacked in the paper delivery tray for ten minutes.

TABLE 10

| | | | | | Comparative Example 4 | | | | | | Embodiment 1 of Example 3 | | | | | | Embodiment 2 of Example 3 | | | | | |
|---|---|---|---|---|---|---|---|---|---|---|---|---|---|---|---|---|---|---|---|---|---|---|
| Case | Combination | | | | Image pattern 1 | | | Image pattern 2 | | | Image pattern 1 | | | Image pattern 2 | | | Image pattern 1 | | | Image pattern 2 | | |
| No. | Y | M | C | K | R | G | TP1 | B | P-Bk | TP2 | R | G | TP1 | B | P-Bk | TP2 | R | G | TP1 | B | P-Bk | TP2 |
| 1 | A | A | A | A | x | x | 5 ppm | x | x | 5 ppm | ○ | ○ | 4 ppm | ○ | ○ | 4 ppm | ○ | ○ | 4 ppm | ○ | ○ | 4 ppm |
| 2 | B | A | A | A | ○ | ○ | | x | ○ | | ○ | ○ | 4 ppm | ○ | ○ | 4 ppm | ○ | ○ | 5 ppm * | ○ | ○ | 4 ppm |
| 3 | A | B | A | A | ○ | x | | ○ | ○ | | ○ | ○ | 4 ppm | ○ | ○ | 4 ppm | ○ | ○ | 4 ppm | ○ | ○ | 5 ppm * |
| 4 | A | A | B | A | x | ○ | | ○ | ○ | | ○ | ○ | 4 ppm | ○ | ○ | 4 ppm | ○ | ○ | 4 ppm | ○ | ○ | 5 ppm * |
| 5 | B | B | A | A | ○ | ○ | | ○ | ○ | | ○ | ○ | 5 ppm | ○ | ○ | 5 ppm | ○ | ○ | 5 ppm | ○ | ○ | 5 ppm |
| 6 | B | A | B | A | ○ | ○ | | ○ | ○ | | ○ | ○ | | ○ | ○ | | ○ | ○ | | ○ | ○ | |
| 7 | A | B | B | A | ○ | ○ | | ○ | ○ | | ○ | ○ | | ○ | ○ | | ○ | ○ | | ○ | ○ | |
| 8 | B | B | B | A | ○ | ○ | | ○ | ○ | | ○ | ○ | | ○ | ○ | | ○ | ○ | | ○ | ○ | |

TABLE 10-continued

| Case | Combination | | | | Comparative Example 4 | | | | | | Embodiment 1 of Example 3 | | | | | | Embodiment 2 of Example 3 | | | | | |
|---|---|---|---|---|---|---|---|---|---|---|---|---|---|---|---|---|---|---|---|---|---|---|
| | | | | | Image pattern 1 | | | Image pattern 2 | | | Image pattern 1 | | | Image pattern 2 | | | Image pattern 1 | | | Image pattern 2 | | |
| No. | Y | M | C | K | R | G | TP1 | B | P-Bk | TP2 | R | G | TP1 | B | P-Bk | TP2 | R | G | TP1 | B | P-Bk | TP2 |
| 9 | B | B | B | B | ○ | ○ | | ○ | ○ | | ○ | ○ | | ○ | ○ | | ○ | ○ | | ○ | ○ | |
| 10 | A | B | B | B | ○ | ○ | | ○ | ○ | | ○ | ○ | | ○ | ○ | | ○ | ○ | | ○ | ○ | |
| 11 | B | A | B | B | ○ | ○ | | ○ | ○ | | ○ | ○ | | ○ | ○ | | ○ | ○ | | ○ | ○ | |
| 12 | B | B | A | B | ○ | ○ | | ○ | ○ | | ○ | ○ | | ○ | ○ | | ○ | ○ | | ○ | ○ | |
| 13 | A | A | B | B | x | ○ | | ○ | ○ | | ○ | ○ | 4 ppm | ○ | ○ | 4 ppm | ○ | ○ | 4 ppm | ○ | ○ | 5 ppm * |
| 14 | A | B | A | B | ○ | x | | ○ | ○ | | ○ | ○ | 4 ppm | ○ | ○ | 4 ppm | ○ | ○ | 4 ppm | ○ | ○ | 5 ppm * |
| 15 | B | A | A | B | ○ | ○ | | x | ○ | | ○ | ○ | 4 ppm | ○ | ○ | 4 ppm | ○ | ○ | 5 ppm * | ○ | ○ | 5 ppm |
| 16 | A | A | A | B | x | x | | x | ○ | | ○ | ○ | 4 ppm | ○ | ○ | 4 ppm | ○ | ○ | 4 ppm | ○ | ○ | 4 ppm |

In Table 10, colors of the image pattern are abbreviated. In other words, in the image pattern 1, red is abbreviated to R, green to G, and in image pattern 2, blue is abbreviated to B, and process black to P-Bk. In Table 10, whether sticking was generated at each color of each image is shown, and the throughput (ppm), when each image in each combination was fed, is shown. The throughput of the image pattern 1 is denoted with TP1, and the throughput of the image pattern 2 is denoted with TP2. O in Table 10 indicates that sticking is not generated, and X indicates that sticking is generated.

As a result, Table 10 shows that sticking was generated in the combinations of No. 1 to No. 4 and No. 13 to No. 16 in Comparative Example 4, but no sticking was generated in any combinations in the case of Embodiment 1 of Example 3 and Embodiment 2 of Example 3. Further, all sheets were printed at 4 ppm throughput for both images in the combinations of No. 2 to No. 4 in Embodiment 1 of Example 3, but, in Embodiment 2 of Example 3, the sheets where printed at 5 ppm, which is faster than 4 ppm, depending on the image.

In other words, regardless which one of Embodiment 1 of Example 3 or Embodiment 2 of Example 3 was used, the user who prints images in gloss paper mode can acquire better images without sticking compared with Comparative Example 4. In particular, if the configuration of Embodiment 2 of Example 3 is used, printing can be performed at a higher throughput than Embodiment 1 of Example 3 depending on the image.

In Example 3, the effect of the invention was described using the sticking of gloss paper (150 g) as an example, but, if sticking is generated using a particular paper type (e.g. thick paper, or overhead transparency (OHT) sheet), then Example 1 to Example 3 may be applied to the mode to print this type of paper. The total density at which sticking is generated is 150% or more, but, needless to say, this value may be any value at which sticking begins to occur. Further, in Example 3, throughput is changed, but a specific cooling time may be set, such as including a one minute wait time for every time five sheets are printed when fifty sheets are continuously printed, so that continuous printing is performed intermittently. In other words, the fixing target temperature may be decreased, or a combination of the decrease of the fixing target temperature and the above intermittent printing may be performed as long as the fixing performance is not diminished beyond an allowable range.

In Example 1 to Example 3 of the present invention, two types of toners having different fixing performance levels are used for each color of cartridge of the color image forming apparatus, and two types of cartridges containing these two types of toner are used, but the number of levels of toner is not limited to two. Three or more types of toner may be used, or, depending on the color, only one type of toner may be used. Critical here is that when a plurality of types of toners having different fixing performance levels are used for any of the colors in the image forming apparatus 100, and these toners are used together with a toner of another color having a different fixing performance, optimum control is performed for the image forming apparatus 100 in accordance with the combination of the toners. In the above example, this combination is detected by the image forming apparatus 100 reading information from a storage element attached to the process cartridge 1 using the reading apparatus, but the present invention is not limited to this configuration. If a toner container part of the process cartridge 1 can be independently replaced, information may be read from the storage element installed in the toner container. Further, in Example 3, the input panel 62 for the user to input information is used as the paper type discriminating portion, but the paper type information may be automatically sent to the CPU 60 using a mechanism configured to automatically detect the paper type. Furthermore, in Example 2 and Embodiment 2 of Example 3, the role of the image discriminating portion is played by the formatter 61, but this role may be played by the CPU 60.

The configuration of each of the above examples may be combined with each other if possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus for forming a toner image on a recording material, comprising:

an apparatus main body;

a plurality of cartridges configured to contain toners of a plurality of different colors and configured to be detachably attached to the apparatus main body, each of the plurality of cartridges including a storage element that stores thermal characteristic information specific to the type of the toner contained therein, the toner being classified into one of at least two types of toner including a first type of toner and a second type of toner that are different from each other based on a degree of fixing performance of the toner to the recording material;

a reading portion configured to read the thermal characteristic information stored in the storage element of each of the plurality of cartridges;

a fixing portion configured to thermally fix the toner image, which is formed by the toners of the plurality of different colors contained in the plurality of cartridges respectively, onto a recording material; and a control portion configured to control the fixing portion so that a temperature of the fixing portion is maintained at a fixing temperature, wherein the control portion sets the fixing temperature in accordance with the thermal characteristic information read by the reading portion, wherein, if the thermal characteristic information for the combination of the plurality of cartridges indicates that a toner, of the toners of the plurality of different colors, that is transferred first to the recording material is the first type of toner, the control portion sets the fixing temperature to be a first fixing temperature that is within a first fixing temperature range, and, if the thermal characteristic information for the combination of the plurality of cartridges indicates that the toner that is transferred first to the recording material is the second type of toner, the control portion sets the fixing temperature to be a second fixing temperature that is within a second fixing temperature range, the second fixing temperature range being different, at least in part, from the first fixing temperature range, and the first fixing temperature range and the second fixing temperature range being set for optimal fixing of the toner that is transferred first to the recording material.

2. The image forming apparatus according to claim 1, further comprising a transfer member, (i) onto which a plurality of toner images, formed of the toners of the plurality of different colors, respectively, are superimposed and transferred as a composite toner image, and (ii) from which the composite toner image is transferred onto a recording material, wherein the toner that is transferred first to the recording material is a toner that is transferred last to the transfer member.

3. The image forming apparatus according to claim 1, wherein the toner that is transferred first to the recording material is black toner.

4. The image forming apparatus according to claim 1, wherein the control portion is further configured to acquire density information on each of the toners of the plurality of different colors that form the toner image, from image information that is used for forming the toner image, and the control portion sets the fixing temperature for the fixing operation based on the acquired density information.

5. The image forming apparatus according to claim 4, wherein the control portion is further configured to correct the fixing temperature for the fixing operation, and wherein in a case in which the combination of the plurality of cartridges is a predetermined combination, the control portion corrects the fixing temperature.

6. The image forming apparatus according to claim 1, wherein the control portion is further configured to acquire information on a type of the recording material onto which the toner image is thermally fixed, and the control portion sets the fixing temperature for the fixing operation based on the acquired type of the recording material.

7. The image forming apparatus according to claim 6, wherein the control portion is further configured to control a conveyance interval of a plurality of recording materials that pass through the image forming apparatus, and, in a case in which the plurality of recording materials is a predetermined type of recording material and the combination of the plurality of cartridges is a predetermined combination, the control portion increases the conveyance interval of the plurality of recording materials when the toner image is continuously and thermally fixed onto the plurality of recording materials.

8. The image forming apparatus according to claim 6, wherein the control portion is further configured to acquire density information on each of the toners of the plurality of different colors that form the toner image, from the image information that is used for forming a toner image, and the control portion sets the fixing temperature for the fixing operation based on the acquired density information.

9. The image forming apparatus according to claim 1, wherein the fixing portion includes a cylindrical film, a heater provided in an inner space of the film, and a roller for forming a fixing nip portion in cooperation with the heater through the film, wherein the toner image formed on the recording material is fixed to the recording material at the fixing nip portion while the recording material being pinched and conveyed at the fixing nip portion.

10. An image forming apparatus for forming a toner image on a recording material, comprising:

a first image forming portion configured to form a first toner image using a first toner of a first color, the first image forming portion includes a first cartridge contains the first toner and detachably attachable to the image forming apparatus;

a second image forming portion configured to form a second toner image using a second toner of a second color, the second image forming portion includes a second cartridge contains the second toner and detachably attachable to the image forming apparatus;

a third image forming portion configured to form a third toner image using a third toner of a third color, the third image forming portion includes a third cartridge contains the third toner and detachably attachable to the image forming apparatus;

a fourth image forming portion configured to form a fourth toner image using a fourth toner of a fourth color, the fourth image forming portion includes a fourth cartridge contains the fourth toner and detachably attachable to the image forming apparatus;

a transfer portion configured to transfer the first to fourth toner images to the recording material;

a fixing portion configured to fix the first to fourth toner images to the recording material, the fixing portion includes a heating member for heating the first to fourth toner images; and a control portion configured to control power supplied to the heating member so that a temperature of the heating member is maintained at a target temperature, wherein the first to fourth toner images transferred to the recording material are superimposed on the recording material in this order, wherein each of the first to fourth cartridge contains a first type toner which is one of the toners classified into two types, or a second type toner which is one of the toners classified into two types and required a higher temperature for fixing than the first type toner, wherein the control portion sets the target temperature at a first case lower than a second case, and wherein the first case is a case where the first image forming portion forms the first toner image using the first type toner and the other image forming portions forms toner images using the second type toner, and the second case is a case where the first image forming portion forms the first toner image using the second type toner and only one of the other image forming portions forms toner image using the first type toner.

11. The image forming apparatus according to claim 10, wherein the first color is black.

12. The image forming apparatus according to claim 10, wherein the fixing portion includes a cylindrical film, and a roller for forming a fixing nip portion in cooperation with the heating member through the film, wherein the toner images superimposed on the recording material is fixed to the recording material at the fixing nip portion while the recording material being pinched and conveyed at the fixing nip portion.

13. An image forming apparatus for forming a toner image on a recording material, comprising:

a first image forming portion configured to form a first toner image using a first toner of a first color, the first image forming portion includes a first cartridge contains the first toner and detachably attachable to the image forming apparatus;

a second image forming portion configured to form a second toner image using a second toner of a second color, the second image forming portion includes a second cartridge contains the second toner and detachably attachable to the image forming apparatus;

a third image forming portion configured to form a third toner image using a third toner of a third color, the third image forming portion includes a third cartridge contains the third toner and detachably attachable to the image forming apparatus;

a fourth image forming portion configured to form a fourth toner image using a fourth toner of a fourth color, the fourth image forming portion includes a fourth cartridge contains the fourth toner and detachably attachable to the image forming apparatus;

a transfer portion configured to transfer the first to fourth toner images to the recording material;

a fixing portion configured to fix the first to fourth toner images to the recording material, the fixing portion includes a heating member for heating the first to fourth toner images; and a control portion configured to control power supplied to the heating member so that a temperature of the heating member is maintained at a target temperature, wherein the first to fourth toner images transferred to the recording material are superimposed on the recording material in this order, wherein each of the first to fourth cartridge contains a first type toner which is one of the toners classified into two types, or a second type toner which is one of the toners classified into two types and required a higher temperature for fixing than the first type toner, wherein the control portion sets the target temperature at a first case higher than a second case, and wherein the first case is a case where the first image forming portion forms the first toner image using the second type toner and the other image forming portions form toner images using the first type toner, and the second case is a case where the first image forming portion forms the first toner image using the first type toner and only one of the other image forming portions forms a toner image using the second type toner.

14. The image forming apparatus according to claim 13, wherein the first color is black.

15. The image forming apparatus according to claim 13, wherein the fixing portion includes a cylindrical film, and a roller for forming a fixing nip portion in cooperation with the heating member through the film, wherein the toner images superimposed on the recording material is fixed to the recording material at the fixing nip portion while the recording material being pinched and conveyed at the fixing nip portion.

* * * * *